US009790681B2

(12) United States Patent
Richardson et al.

(10) Patent No.: US 9,790,681 B2
(45) Date of Patent: Oct. 17, 2017

(54) PANEL-TO-PANEL CONNECTIONS FOR STAY-IN-PLACE LINERS USED TO REPAIR STRUCTURES

(71) Applicant: CFS Concrete Forming Systems Inc., Vancouver (CA)

(72) Inventors: George David Richardson, Vancouver (CA); Semion Krivulin, Richmond (CA); Zi Li Fang, New Westminster (CA)

(73) Assignee: CFS Concrete Forming Systems Inc., Vancouver, British Columbia ( * ) Notice: Subject to any disclaimer, the term of this patent is extended or adjusted under 35 U.S.C. 154(b) by 0 days.

(21) Appl. No.: 15/190,106

(22) Filed: Jun. 22, 2016

(65) Prior Publication Data

US 2016/0348364 A1 Dec. 1, 2016

Related U.S. Application Data

(63) Continuation of application No. 14/368,921, filed as application No. PCT/CA2013/050004 on Jan. 4, 2013, now Pat. No. 9,453,345.

(Continued)

(51) Int. Cl.

*E04G 17/00* (2006.01)
*E04B 2/86* (2006.01)

(Continued)

(52) U.S. Cl.

CPC ..... *E04B 2/8617* (2013.01); *B25B 7/02* (2013.01); *B25B 27/00* (2013.01); *E04B 2/8652* (2013.01);

(Continued)

(58) Field of Classification Search

CPC ..... E04G 13/023; E04G 13/031; E04G 13/02; E04G 23/0218; E04G 23/02;

(Continued)

(56) References Cited

U.S. PATENT DOCUMENTS 154,179 A 8/1874 Hubert
374,826 A 12/1887 Clarke (Continued)

FOREIGN PATENT DOCUMENTS

CA 0574720 4/1959
CA 0957816 11/1974

(Continued)

OTHER PUBLICATIONS

Vector Corrosion Technologies Marketing Materials, 2005.

(Continued)

*Primary Examiner* — Christine T Cajilig
(74) *Attorney, Agent, or Firm* — Todd A. Rattray; Oyen Wiggs Green & Mutala LLP

(57) ABSTRACT

A stay-in-place lining is provided for lining a structure fabricated from concrete. The lining comprises a plurality of panels connectable via complementary connector components on their longitudinal edges. Each panel comprises a first connector component on a first longitudinal edge thereof and a second (complementary) connector component on a second longitudinal edge thereof. The lining comprises at least one edge-to-edge connection between the first connector component of a first panel and the second connector component of a second panel, the edge-to-edge connection comprising a protrusion of the first panel extended into a receptacle of the second panel through a receptacle opening. The receptacle is shaped to prevent removal of the protrusion from the receptacle and the receptacle is resiliently deformed by the extension of the protrusion into the recep- (Continued)

tacle to thereby apply a restorative force to the protrusion to maintain the edge-to-edge connection.

19 Claims, 11 Drawing Sheets

Related U.S. Application Data

(60) Provisional application No. 61/583,589, filed on Jan. 5, 2012, provisional application No. 61/703,209, filed on Sep. 19, 2012.

(51) Int. Cl.

| | |
|---|---|
| ***E04G 23/02*** | (2006.01) |
| ***E04H 9/02*** | (2006.01) |
| ***E04F 13/26*** | (2006.01) |
| ***E04F 21/00*** | (2006.01) |
| ***B25B 7/02*** | (2006.01) |
| ***B25B 27/00*** | (2006.01) |
| ***E04F 13/24*** | (2006.01) |

(52) U.S. Cl.
CPC ..... *E04B 2/8664* (2013.01); *E04F 13/24* (2013.01); *E04F 13/26* (2013.01); *E04F 21/00* (2013.01); *E04G 23/0218* (2013.01); *E04G 23/0225* (2013.01); *E04H 9/027* (2013.01)

(58) Field of Classification Search
CPC . E04G 23/0203; E04B 2/8611; E04B 2/8641; E04F 13/26; E04F 13/0894; E04F 21/02; Y10T 403/7094
See application file for complete search history.

(56) References Cited

U.S. PATENT DOCUMENTS

| | | | |
|---|---|---|---|
| 510,720 | A | 12/1893 | Stewart, Jr. |
| 820,246 | A | 5/1906 | Nidds |
| 999,334 | A | 8/1911 | Pearson |
| 1,035,206 | A | 8/1912 | Lewen |
| 1,080,221 | A | 12/1913 | Jester |
| 1,175,168 | A | 3/1916 | Moulton |
| 1,244,608 | A | 10/1917 | Hicks |
| 1,276,147 | A | 8/1918 | White |
| 1,345,156 | A | 6/1920 | Flynn |
| 1,423,879 | A | 7/1922 | Potter |
| 1,540,570 | A | 6/1925 | Roberts |
| 1,637,410 | A | 8/1927 | Corybell |
| 1,653,197 | A | 12/1927 | Barnes |
| 1,715,466 | A | 6/1929 | Miller |
| 1,820,897 | A | 8/1931 | White et al. |
| 1,875,242 | A | 8/1932 | Hathaway |
| 1,915,611 | A | 6/1933 | Miller |
| 1,963,153 | A | 6/1934 | Schmieder |
| 2,008,162 | A | 7/1935 | Waddell |
| 2,050,258 | A | 8/1936 | Bemis |
| 2,059,483 | A | 11/1936 | Parsons |
| 2,076,472 | A | 4/1937 | London |
| 2,164,681 | A | 7/1939 | Fould |
| 2,172,052 | A | 9/1939 | Robbins |
| 2,314,448 | A | 3/1943 | Hoggatt |
| 2,326,361 | A | 8/1943 | Jacobsen |
| 2,354,485 | A | 7/1944 | Slaughter |
| 2,845,685 | A | 8/1958 | Lovgren et al. |
| 2,861,277 | A | 11/1958 | Hermann |
| 2,871,619 | A | 2/1959 | Walters |
| 2,892,340 | A | 6/1959 | Fort |
| 2,928,115 | A | 3/1960 | Hill |
| 3,063,122 | A | 11/1962 | Katz |
| 3,100,677 | A | 8/1963 | Frank et al. |
| 3,152,354 | A | 10/1964 | Diack |
| 3,184,013 | A | 5/1965 | Pavlecka |
| 3,196,990 | A | 7/1965 | Handley |
| 3,199,258 | A | 8/1965 | Jentoft et al. |
| 3,220,151 | A | 11/1965 | Goldman |
| 3,242,834 | A | 3/1966 | Sondheim |
| 3,288,427 | A | 11/1966 | Pluckebaum |
| 3,291,437 | A | 12/1966 | Bowden et al. |
| 3,321,884 | A | 5/1967 | Klaue |
| 3,468,088 | A | 9/1969 | Miller |
| 3,545,152 | A | 12/1970 | Knohl |
| 3,555,751 | A | 1/1971 | Thorgusen |
| 3,588,027 | A | 6/1971 | Bowden |
| 3,682,434 | A | 8/1972 | Boenig |
| 3,769,769 | A | 11/1973 | Kohl |
| 3,788,020 | A | 1/1974 | Gregori |
| 3,822,557 | A | 7/1974 | Frederick |
| 3,886,705 | A | 6/1975 | Cornland |
| 3,951,294 | A | 4/1976 | Wilson |
| 3,959,940 | A | 6/1976 | Ramberg |
| 3,991,636 | A | 11/1976 | Devillers |
| 4,023,374 | A | 5/1977 | Colbert et al. |
| 4,060,945 | A | 12/1977 | Wilson |
| 4,104,837 | A | 8/1978 | Naito |
| 4,106,233 | A | 8/1978 | Horowitz |
| 4,114,388 | A | 9/1978 | Straub |
| 4,180,956 | A | 1/1980 | Gross |
| 4,182,087 | A | 1/1980 | Schall et al. |
| 4,193,243 | A | 3/1980 | Tiner |
| 4,276,730 | A | 7/1981 | Lewis |
| 4,299,070 | A | 11/1981 | Ottmanns et al. |
| 4,332,119 | A | 6/1982 | Toews |
| 4,351,870 | A | 9/1982 | English |
| 4,383,674 | A | 5/1983 | Fricker |
| 4,430,831 | A | 2/1984 | Kemp |
| 4,433,522 | A | 2/1984 | Yerushalmi |
| 4,434,597 | A | 3/1984 | Fischer |
| 4,508,310 | A | 4/1985 | Schultz |
| 4,532,745 | A | 8/1985 | Kinard |
| 4,543,764 | A | 10/1985 | Kozikowski |
| 4,550,539 | A | 11/1985 | Foster |
| 4,553,875 | A | 11/1985 | Casey |
| 4,575,985 | A | 3/1986 | Eckenrodt |
| 4,581,864 | A | 4/1986 | Shvakhman et al. |
| 4,606,167 | A | 8/1986 | Thorne |
| 4,664,560 | A | 5/1987 | Cortlever |
| 4,695,033 | A | 9/1987 | Imaeda et al. |
| 4,703,602 | A | 11/1987 | Pardo |
| 4,731,964 | A | 3/1988 | Phillips |
| 4,731,971 | A | 3/1988 | Terkl |
| 4,742,665 | A | 5/1988 | Baierl |
| 4,808,039 | A | 2/1989 | Fischer |
| 4,856,754 | A | 8/1989 | Yokota et al. |
| 4,866,891 | A | 9/1989 | Young |
| 4,930,282 | A | 6/1990 | Meadows |
| 4,946,056 | A | 8/1990 | Stannard |
| 4,995,191 | A | 2/1991 | Davis |
| 5,014,480 | A | 5/1991 | Guarriello et al. |
| 5,028,368 | A | 7/1991 | Grau |
| 5,058,855 | A | 10/1991 | Ward |
| 5,078,360 | A | 1/1992 | Spera |
| 5,106,233 | A | 4/1992 | Breaux |
| 5,124,102 | A | 6/1992 | Serafini |
| 5,187,843 | A | 2/1993 | Lynch |
| 5,216,863 | A | 6/1993 | Nessa et al. |
| 5,243,805 | A | 9/1993 | Fricker |
| 5,247,773 | A | 9/1993 | Weir |
| 5,265,750 | A | 11/1993 | Whiteley |
| 5,292,208 | A | 3/1994 | Berger |
| 5,311,718 | A | 5/1994 | Trousilek |
| 5,465,545 | A | 11/1995 | Trousilek |
| 5,489,468 | A | 2/1996 | Davidson |
| 5,491,947 | A | 2/1996 | Kim |
| 5,513,474 | A | 5/1996 | Scharkowski |
| 5,516,863 | A | 5/1996 | Abusleme et al. |
| 5,553,430 | A | 9/1996 | Majnaric et al. |
| 5,591,265 | A | 1/1997 | Tusch |
| 5,608,999 | A | 3/1997 | McNamara |
| 5,625,989 | A | 5/1997 | Brubaker et al. |
| 5,714,045 | A | 2/1998 | Lasa et al. |
| 5,729,944 | A | 3/1998 | De Zen |
| 5,740,648 | A | 4/1998 | Piccone |

(56) References Cited

U.S. PATENT DOCUMENTS

| | | | |
|---|---|---|---|
| 5,747,134 | A | 5/1998 | Mohammed et al. |
| 5,791,103 | A | 8/1998 | Coolman |
| 5,824,347 | A | 10/1998 | Serafini |
| 5,860,262 | A | 1/1999 | Johnson |
| 5,953,880 | A | 9/1999 | De Zen |
| 5,987,830 | A | 11/1999 | Worley |
| 6,053,666 | A | 4/2000 | Irvine et al. |
| 6,151,856 | A | 11/2000 | Shimonohara |
| 6,161,989 | A | 12/2000 | Kotani et al. |
| 6,167,669 | B1 | 1/2001 | Lanc |
| 6,167,672 | B1 | 1/2001 | Okitomo |
| 6,178,711 | B1 | 1/2001 | Laird et al. |
| 6,185,884 | B1 | 2/2001 | Myers et al. |
| 6,189,269 | B1 | 2/2001 | De Zen |
| 6,212,845 | B1 | 4/2001 | De Zen |
| 6,219,984 | B1 | 4/2001 | Piccone |
| 6,220,779 | B1 | 4/2001 | Warner et al. |
| 6,247,280 | B1 | 6/2001 | Grinshpun et al. |
| 6,286,281 | B1 | 9/2001 | Johnson |
| 6,293,067 | B1 | 9/2001 | Meendering et al. |
| 6,357,196 | B1 | 3/2002 | McCombs |
| 6,387,309 | B1 | 5/2002 | Kojima |
| 6,405,508 | B1 | 6/2002 | Janesky |
| 6,435,470 | B1 | 8/2002 | Lahham et al. |
| 6,435,471 | B1 | 8/2002 | Piccone |
| 6,438,918 | B2 | 8/2002 | Moore et al. |
| 6,467,136 | B1 | 10/2002 | Graham |
| 6,530,185 | B1 | 3/2003 | Scott et al. |
| 6,550,194 | B2 | 4/2003 | Jackson et al. |
| 6,588,165 | B1 | 7/2003 | Wright |
| 6,622,452 | B2 | 9/2003 | Alvaro |
| 6,691,976 | B2 | 2/2004 | Myers et al. |
| 6,694,692 | B2 | 2/2004 | Piccone |
| 6,832,456 | B1 | 12/2004 | Bilowol |
| 6,866,445 | B2 | 3/2005 | Semler |
| 6,935,081 | B2 | 8/2005 | Dunn et al. |
| 7,320,201 | B2 | 1/2008 | Kitchen et al. |
| 7,444,788 | B2 | 11/2008 | Morin et al. |
| 7,818,936 | B2 | 10/2010 | Morin et al. |
| 8,074,418 | B2 | 12/2011 | Thiagarajan et al. |
| 8,485,493 | B2 | 7/2013 | Wells et al. |
| 8,707,648 | B2 | 4/2014 | Timko et al. |
| 8,769,904 | B1 | 7/2014 | Brandt et al. |
| 8,806,839 | B2 | 8/2014 | Zhou |
| 8,881,483 | B2 | 11/2014 | Caboni |
| 8,959,871 | B2 | 2/2015 | Parenti et al. |
| 2003/0005659 | A1 | 1/2003 | Moore, Jr. |
| 2003/0085482 | A1 | 5/2003 | Sincock et al. |
| 2003/0155683 | A1 | 8/2003 | Pietrobon |
| 2004/0010994 | A1 | 1/2004 | Piccone |
| 2004/0020149 | A1 | 2/2004 | Messiqua |
| 2004/0093817 | A1 | 5/2004 | Pujol Barcons |
| 2004/0216408 | A1 | 11/2004 | Hohmann, Jr. |
| 2005/0016083 | A1 | 1/2005 | Morin et al. |
| 2005/0016103 | A1 | 1/2005 | Piccone |
| 2006/0179762 | A1 | 8/2006 | Thome et al. |
| 2006/0185270 | A1 | 8/2006 | Handley et al. |
| 2006/0213140 | A1 | 9/2006 | Morin et al. |
| 2007/0028544 | A1 | 2/2007 | Messiqua et al. |
| 2007/0107341 | A1 | 5/2007 | Zhu |
| 2007/0193169 | A1 | 8/2007 | Emblin |
| 2008/0168734 | A1 | 7/2008 | Degen et al. |
| 2009/0120027 | A1 | 5/2009 | Amend |
| 2009/0229214 | A1 | 9/2009 | Nelson |
| 2009/0269130 | A1 | 10/2009 | Williams |
| 2010/0047608 | A1 | 2/2010 | Seccombe |
| 2010/0050552 | A1 | 3/2010 | David |
| 2010/0071304 | A1 | 3/2010 | Richardson et al. |
| 2010/0251657 | A1 | 10/2010 | Richardson et al. |
| 2010/0325984 | A1 | 12/2010 | Richardson et al. |
| 2011/0000161 | A1 | 1/2011 | Aube |
| 2011/0099932 | A1 | 5/2011 | Saulce |
| 2011/0131914 | A1 | 6/2011 | Richardson et al. |
| 2011/0277410 | A1 | 11/2011 | Richardson |
| 2012/0056344 | A1 | 3/2012 | Richardson et al. |
| 2013/0081345 | A1 | 4/2013 | Sheehy |

FOREIGN PATENT DOCUMENTS

| | | |
|---|---|---|
| CA | 1316366 | 4/1993 |
| CA | 2097226 | 11/1994 |
| CA | 2141463 | 8/1996 |
| CA | 2070079 | 6/1997 |
| CA | 2170681 | 8/1997 |
| CA | 2218600 | 6/1998 |
| CA | 2215939 | 8/1999 |
| CA | 2226497 | 10/1999 |
| CA | 2243905 | 1/2000 |
| CA | 2255256 | 1/2000 |
| CA | 2244537 | 2/2000 |
| CA | 2418885 | 8/2003 |
| CA | 2502343 | 5/2004 |
| CA | 2502392 | 5/2004 |
| CA | 2499450 | 9/2005 |
| CA | 2577217 | 1/2006 |
| CA | 2629202 | 4/2008 |
| CA | 2716118 | 8/2008 |
| CA | 2681963 | 10/2008 |
| CA | 2751134 | 12/2011 |
| CA | 2855742 | 5/2013 |
| CH | 317758 | 1/1957 |
| CH | 669235 | 2/1989 |
| CN | 2529936 | 1/2003 |
| DE | 1684357 | 4/1967 |
| DE | 1812590 | 6/1970 |
| DE | 2062723 | 8/1972 |
| DE | 3003446 | 8/1981 |
| DE | 3234489 | 3/1984 |
| DE | 3727956 | 5/1988 |
| DE | 29803155 | 6/1998 |
| EP | 0025420 | 3/1981 |
| EP | 0055504 | 7/1982 |
| EP | 0141782 | 5/1985 |
| EP | 0179046 | 4/1986 |
| EP | 0757137 | 2/1997 |
| EP | 2169133 | 3/2010 |
| FR | 0507787 | 7/1920 |
| FR | 1381945 | 11/1964 |
| FR | 1603005 | 4/1971 |
| FR | 2364314 | 4/1978 |
| FR | 2535417 | 5/1984 |
| FR | 2721054 | 6/1994 |
| FR | 2717848 | 9/1995 |
| FR | 2669364 | 3/2012 |
| GB | 137221 | 1/1920 |
| GB | 779916 | 7/1957 |
| GB | 1243173 | 8/1971 |
| GB | 1253447 | 11/1971 |
| GB | 2141661 | 1/1985 |
| GB | 2205624 | 12/1988 |
| JP | 05133028 | 5/1993 |
| JP | 09041612 | 2/1997 |
| JP | 2008223335 | 9/2008 |
| SE | 206538 | 8/1966 |
| WO | 8204088 | 11/1982 |
| WO | 9500724 | 1/1995 |
| WO | 9607799 | 3/1996 |
| WO | 9635845 | 11/1996 |
| WO | 9743496 | 11/1997 |
| WO | 0163066 | 8/2001 |
| WO | 0173240 | 10/2001 |
| WO | 03006760 | 1/2003 |
| WO | 2004088064 | 10/2004 |
| WO | 2005040526 | 5/2005 |
| WO | 2008119178 | 10/2008 |
| WO | 2009059410 | 5/2009 |
| WO | 2009092158 | 7/2009 |
| WO | 2010012061 | 2/2010 |

(56) References Cited

FOREIGN PATENT DOCUMENTS

| | | |
|---|---|---|
| WO | 2010037211 | 4/2010 |
| WO | 2010078645 | 7/2010 |
| WO | 2010094111 | 8/2010 |

OTHER PUBLICATIONS

Vector Corrosion Technologies Marketing Materials, 2007.
Vector Corrosion Technologies Marketing Materials, 2008.
Digigraph Brochure, Building Systems using PVC extrusions and concrete, accessed online Jan. 2012.
Digigraph Guide, Digigraph Systems Inc., Installation Guide for the Digigraph Construction System Composed of PVC Extrusions and Concrete, accessed online Jan. 2012.
The Digigraph System, http://www.digigraph-housing.com/web/system.ht, accessed online Jan. 2012.

PANEL-TO-PANEL CONNECTIONS FOR STAY-IN-PLACE LINERS USED TO REPAIR STRUCTURES

REFERENCE TO RELATED APPLICATIONS

This application is a continuation of U.S. application Ser. No. 14/368,921 having a 371 date of 26 Jun. 2014 which in turn is a national entry of PCT application No. PCT/CA2013/050004 having an international filing date of 4 Jan. 2013 which in turn claims priority from U.S. application No. 61/583,589 filed 5 Jan. 2012 and U.S. application No. 61/703,209 filed 19 Sep. 2012. All of the applications and patents referred to in this paragraph are hereby incorporated herein by reference.

TECHNICAL FIELD

The application relates to methods and apparatus (systems) for restoring, repairing, reinforcing, protecting, insulating and/or cladding a variety of structures. Some embodiments provide stay-in-place liners (or portions thereof) for containing concrete or other curable material(s). Some embodiments provide stay-in-place liners (or portions thereof) which line interior surfaces of supportive formworks and which are anchored to curable materials as they are permitted to cure.

BACKGROUND

Concrete is used to construct a variety of structures, such as building walls and floors, bridge supports, dams, columns, raised platforms and the like. Typically, concrete structures are formed using embedded reinforcement bars (often referred to as rebar) or similar steel reinforcement material, which provides the resultant structure with increased strength. Over time, corrosion of the embedded reinforcement material can impair the integrity of the embedded reinforcement material, the surrounding concrete and the overall structure. Similar degradation of structural integrity can occur with or without corrosion over sufficiently long periods of time, in structures subject to large forces, in structures deployed in harsh environments, in structures coming into contact with destructive materials or the like.

FIG. 1A shows a cross-sectional view of an exemplary damaged structure 10. In the exemplary illustration, structure 10 is a column, although generally structure 10 may comprise any suitable structure (or portion thereof). The column of structure 10 is generally rectangular in cross-section and extends vertically (i.e. into and out of the page in the FIG. 1A view). Structure 10 includes a portion 9 having a surface 14 that is damaged in regions 16A and 16B (collectively, damaged regions 16). The damage to structure 10 has changed the cross-sectional shape of portion 9 (and surface 14) in damaged regions 16. In damaged region 16A, rebar 18 is exposed.

FIG. 1B shows a cross-sectional view of another exemplary damaged structure 20. In the exemplary illustration, structure 20 is a column, although generally structure 20 may comprise any suitable structure (or portion thereof). The column of structure 20 is generally round in cross-section and extends in the vertical direction (i.e. into and out of the page in the FIG. 1B view). Structure 20 includes a portion 22 having a surface 24 that is damaged in region 26.

There is a desire for methods and apparatus for repairing and/or restoring existing structures which have been degraded or which are otherwise in need of repair and/or restoration.

Some structures have been fabricated with inferior or sub-standard structural integrity. By way of non-limiting example, some older structures may have been fabricated in accordance with seismic engineering specifications that are lower than, or otherwise lack conformity with, current structural (e.g. seismic) engineering standards. There is a desire to reinforce existing structures to upgrade their structural integrity or other aspects thereof.

There is also a desire to protect existing structures from damage which may be caused by, or related to, the environments in which the existing structures are deployed and/or the materials which come into contact with the existing structures. By way of non-limiting example, structures fabricated from metal or concrete can be damaged when they are deployed in environments that are in or near salt water or in environments where the structures are exposed to salt or other chemicals used to de-ice roads.

There is also a desire to insulate existing structures—e.g. to minimize heat transfer across (and/or into and out of) the structure. There is also a general desire to clad existing structures using suitable cladding materials. Such cladding materials may help to repair, restore, reinforce, protect and/or insulate the existing structure.

Previously known techniques for repairing, restoring, reinforcing, protecting, insulating and/or cladding existing structures often use excessive amounts of material and are correspondingly expensive to implement. In some previously known techniques, unduly large amounts of material are used to provide standoff components and/or anchoring components, causing corresponding expense. There is a general desire to repair, restore, reinforce, protect, insulate and/or clad existing structures using a suitably small amount of material, so as to minimize expense.

The desire to repair, restore, reinforce, protect, insulate and/or clad existing structures is not limited to concrete structures. There are similar desires for existing structures fabricated from other materials.

The foregoing examples of the related art and limitations related thereto are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

One aspect of the invention provides a stay in place lining for lining a structure fabricated from concrete or other curable construction material. The stay-in-place lining comprises a plurality of panels connectable edge-to-edge via complementary connector components on their longitudinal edges to define at least a portion of a perimeter of a lining. Each panel comprises a first connector component on a first longitudinal edge thereof and a second connector component on a second longitudinal edge thereof, the second longitudinal connector component complementary to the first connector component. The lining comprises at least one edge-to-edge connection between the first connector component of a first panel and the second connector component of a second panel, the edge-to-edge connection comprising a protrusion of the first connector component of the first panel extended into a receptacle of the second connector component of the second panel through a receptacle opening, the receptacle shaped to prevent removal of the protrusion from the receptacle and the receptacle resiliently deformed by the extension of the protrusion into the receptacle to thereby apply a restorative force to the protrusion to maintain the edge-to-edge connection.

Another aspect of the invention provides a method for fabricating a structure of concrete or other curable construction material. The method comprises: connecting a plurality of panels in edge to edge relation via complementary connector components on their longitudinal edges to define at least a portion of a lining by extending a protrusion of a first connector component on a first longitudinal edge of the panels into a receptacle of a second connector component on a second longitudinal edge of the panels wherein the receptacle is shaped to prevent removal of the protrusion from the receptacle and the receptacle is resiliently deformed by the protrusion to apply a restorative force to the protrusion to maintain the edge-to-edge connection; forming a formwork around a space in which to receive the concrete or other curable material; assembling the connected plurality of panels such that the connected plurality of panels provides a lining which defines at least a portion of the space in which to receive the concrete or other curable material; and introducing the concrete or other curable material into the space in an uncured state.

Another aspect of the invention provides a stay in place lining for lining a structure of concrete or other curable construction material comprising: a plurality of panels connectable in edge to edge relation via complementary connector components on their longitudinal edges to define at least a portion of a perimeter of the lining; wherein each panel comprises a first connector component comprising a protrusion on a first longitudinal edge thereof and a second connector component comprising a receptacle on a second longitudinal edge thereof, each edge-to-edge connection comprising the protrusion of the first panel extended into the receptacle of the second panel; the protrusion comprising a generally straight stem extending from a base of the protrusion and a barb extending from the stem and toward the base of the protrusion as it extends away from the stem; and the receptacle comprising a catch positioned to engage the barb when the protrusion is extended into the receptacle, the engagement of the barb and the catch retaining the connector components in a locked configuration.

In addition to the exemplary aspects and embodiments described above, further aspects and embodiments will become apparent by reference to the drawings and by study of the following detailed descriptions.

BRIEF DESCRIPTION OF THE DRAWINGS

Exemplary embodiments are illustrated in referenced figures of the drawings. It is intended that the embodiments and figures disclosed herein are to be considered illustrative rather than restrictive.

DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Apparatus and methods according to various embodiments may be used to repair, restore, reinforce and/or protect existing structures using concrete and/or similar curable materials. For brevity, in this description and the accompanying claims, apparatus and methods according to various embodiments may be described as being used to "repair" existing structures. In this context, the verb "to repair" and its various derivatives should be understood to have a broad meaning which may include, without limitation, to restore, to reinforce and/or to protect the existing structure. Similarly, structures added to existing structures in accordance with particular embodiments of the invention may be referred to in this description and the accompanying claims as "repair structures". However, such "repair structures" should be understood in a broad context to include additive structures which may, without limitation, repair, restore, reinforce and/or protect existing structures. In some applications which will be evident to those skilled in the art, such "repair structures" may be understood to include structures which insulate or clad existing structures. Further, many of the existing structures shown and described herein exhibit damaged portions which may be repaired in accordance with particular embodiments of the invention. In general, however, it is not necessary that existing structures be damaged and the methods and apparatus of particular aspects of the invention may be used to repair, restore, reinforce or protect existing structures which may be damaged or undamaged. Similarly, in some applications which will be evident to those skilled in the art, methods and apparatus of particular aspects of the invention may be understood to insulate or clad existing structures which may be damaged or undamaged.

Aspects of particular embodiments of the invention provide panels for use in stay-in-place lining systems and corresponding connector components for forming edge-to-edge connections between such panels. Some embodiments provide methods of making connections between such panels.

Figure 1A:
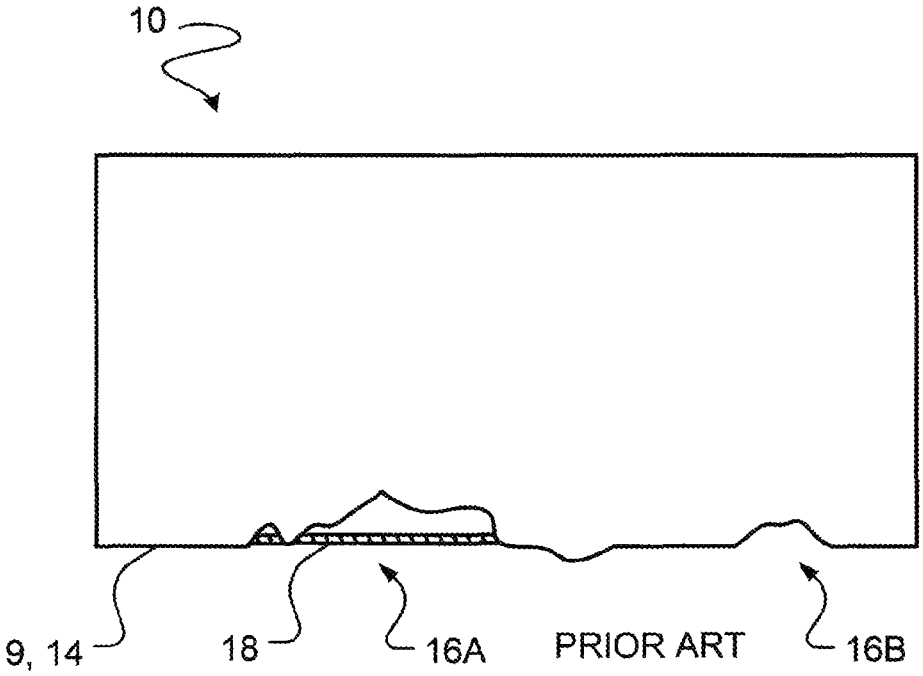
FIGS. 1A and 1B are cross-sectional views of exemplary damaged structures.
Figure 1B:
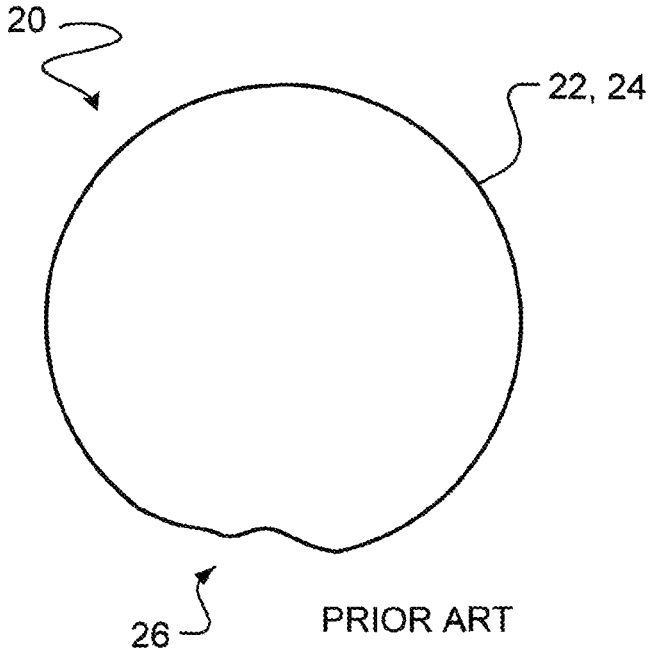
Figure 2:
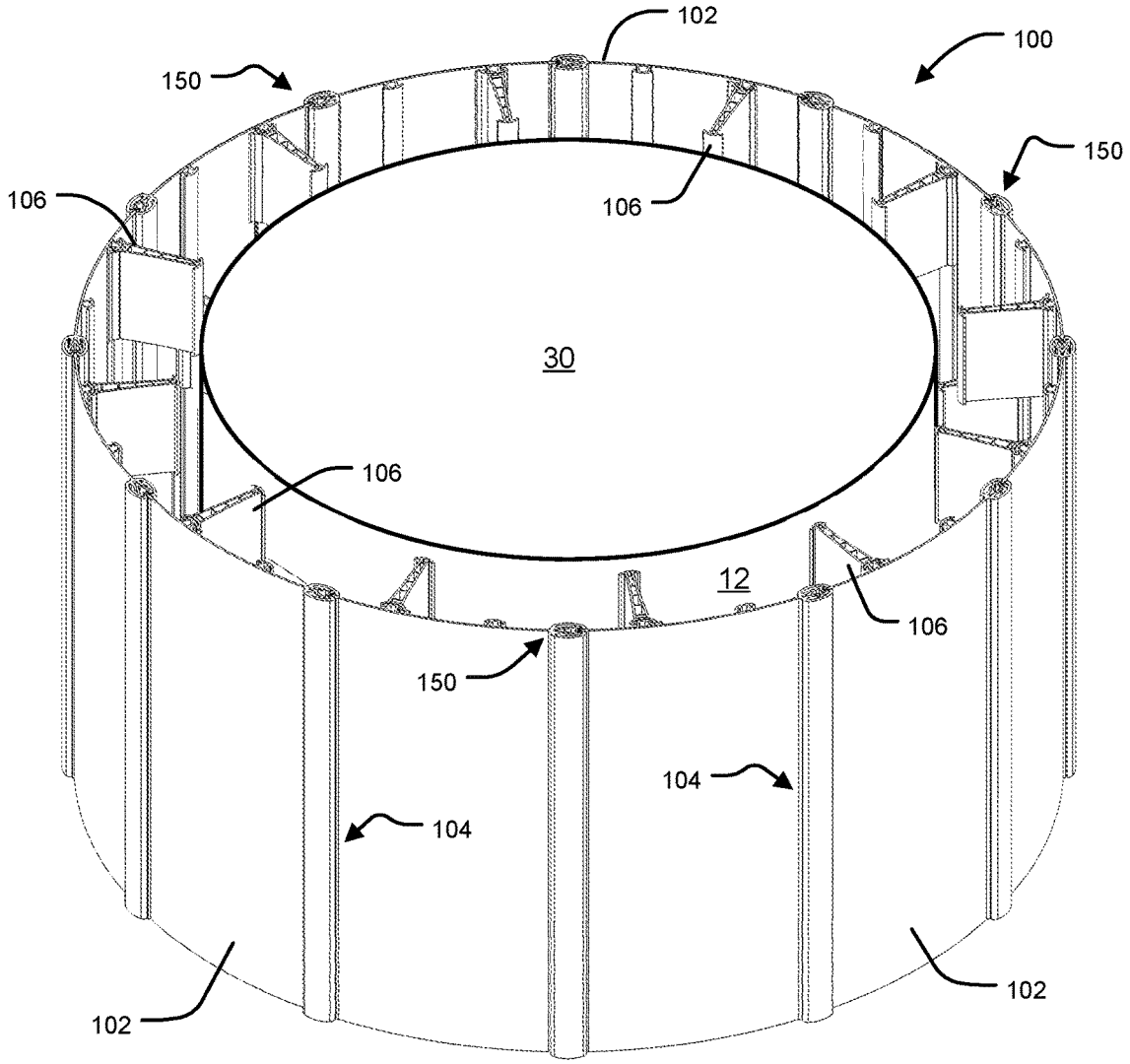
FIG. 2 is a perspective view of an example stay-in-place lining system for repairing an existing structure according to a particular embodiment.

FIG. 2 is a perspective view of a stay-in-place lining system 100 for repairing an existing structure 30 with a lined (or cladded) repair structure formed of concrete or other curable material. Lining system 100 comprises a number of panels 102 connected in edge-to-edge relationship along their longitudinal edges 104 by edge-to-edge connections 150. Lining system 100 also comprises a number of standoffs 106, which may space panels 102 away from existing structure 30 to form a space 12. To form the repair structure, concrete (or other curable material) may be introduced into space 12 between panels 102 and existing structure 30 and cured so that standoffs 106 are embedded in the concrete and lining system 100 (together with the cured concrete in space 12) forms a lined (or cladded) repair structure around existing structure 30. In the illustrated embodiment, lining system 100 and the resultant repair structure extend around a perimeter of existing structure 30. This is not necessary, however, and in some embodiments, lining systems and resultant repair structures may be used to repair a portion of an existing structure.

In some embodiments, lining system 100 may also be used as a formwork (or a portion of a formwork) to retain concrete or other curable material as it cures in space 12 between existing structure 30 and lining system 100. In some embodiments, lining system 100 may be used with an external formwork (or external bracing (not shown) which supports the lining system 100 while concrete or other curable material cures in space 12. The external formwork may be removed and optionally re-used after the curable material cures. In some embodiments, lining system 100 may be used (with or without external formwork or bracing) to fabricate independent structures (i.e. structures that do not line existing structures and are otherwise independent of existing structures).

Components of lining system 100 may be formed of a suitable plastic (e.g. polyvinyl chloride (PVC), acrylonitrile butadiene styrene (ABS) or the like) using an extrusion process. It will be understood, however, that lining system 100 components could be fabricated from other suitable materials, such as, by way of non-limiting example, suitable metals or metal alloys, polymeric materials, fibreglass, carbon fibre material or the like and that lining system 100 components described herein could be fabricated using any other suitable fabrication techniques.

Generally, lining system 100 components may be formed of a resiliently (e.g. elastically) deformable material such as appropriate plastics described above. The resiliently deformable nature of these components allow lining system 100 components to be deformed as connections, such as edge-to-edge connection 150, are formed. As a result, lining system 100 components (or portions thereof) may apply restorative deformation forces on other lining system 100 components (or portions thereof) and may allow for components to resiliently "snap" back to a less deformed state. This may allow for more secure connections or connections that may withstand deformation while minimizing leaking and the creation of gaps in the connection.

Figure 3:
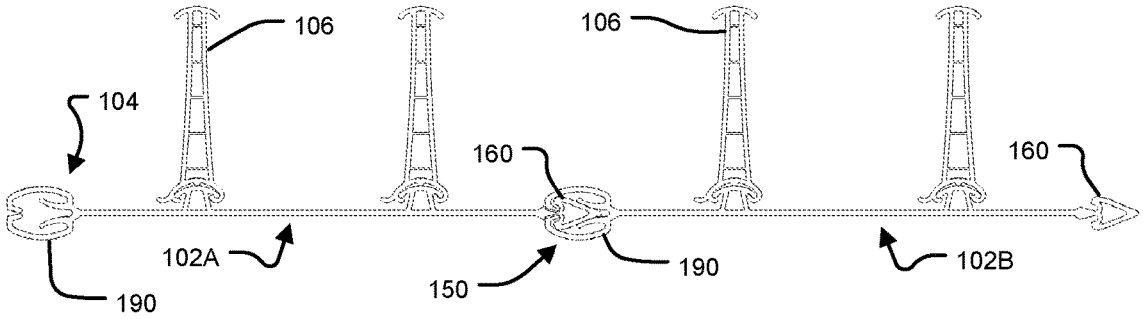
FIG. 3 is a top plan view of two panels of the FIG. 2 lining system connected by an edge-to-edge connection.

FIG. 3 is a top plan view of two panels 102A, 102B of lining system 100 connected by edge-to-edge connection 150 and connected to standoffs 106. Each panel 102 comprises a first connector component 160 and a second connector component 190 located along opposing longitudinal edges 104 of panel 102. Connection 150 between edge-adjacent panels 102 is formed by inserting first connector component 160 of panel 102A into second connector component 190 of panel 102B as described in more detail below. Edge-to-edge connection 150, along with panels 102, keeps the concrete or other curable material within the lining system 100 and, in some embodiments, maintains a liquid-tight seal to help reduce contamination or deterioration of the existing structure 10 and/or the repair structure formed using lining system 100.

Connection 150, and in particular connector components 160, 190, of the illustrated embodiment are symmetrical about and/or aligned with the plane of panels 102A, 102B. The alignment and/or (at least) outer symmetry of connection 150 with the plane of panels 102A, 102B may provide a strong connection by minimizing potential moments applied to connection 150. That is, forces applied to panels 102 in plane cause minimal moments on connection 150, reducing any twisting which could tend to release or weaken connection 150. In some embodiments, this in-line symmetry of connections 150 and connector components 160, 190 is not necessary. In some embodiments, it may be desirable to provide an exterior surface of panels 102A, 102B with a flush appearance. Consequently, connections 150 and connector components 160, 190 may be inwardly offset from the plane of panels 102A, 102B.

Second connector component 190 has an outer profile with a generally elliptical shape. Shapes such as the elliptical shape of second connector component 190 may provide an aerodynamic connection that reduces the drag associated with connection 150. Reducing drag may be important when, for example, lining system 100 is used in an aqueous environment and it is desirable to maintain appropriate flow conditions around connections 150. The elliptical shape of second connector component 190 also reduces the number of sharp corners in connection 150. This can reduce the potential negative impact on users and/or fauna that may interact with lining system 100.

FIGS. 4A to 4F are partial top plan views of the connection process of an example connection 150 between first connector component 160 of panel 102A and second connector component 190 of panel 102B. To form connection 150, first connector component 160 is forced in direction 15 into second connector component 190.

Figure 4A:
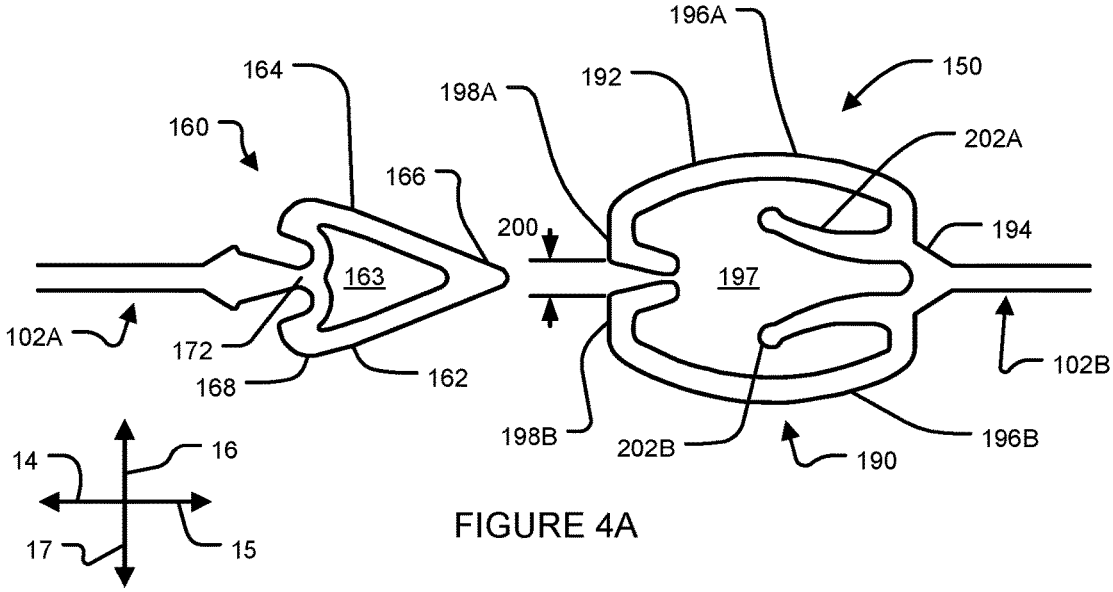
FIGS. 4A to 4F are partial top plan views of the connection process of the FIG. 3 connection.

FIG. 4A shows first connector component 160 and second connector component 190 prior to the formation of edge-to-edge connection 150. In the illustrated embodiment, first connector component 160 comprises a protrusion 162 having a tapered head 164 with a narrow end 166 at the tip and a wide end 168 near the base 172 of protrusion 162. In the FIG. 4 embodiment, protrusion 162 is generally arrowhead shaped and is hollow with a space 163 formed therein. Space 163 is not necessary.

Second connector component 190 comprises a receptacle 192 shaped to complement and receive protrusion 162. Receptacle 192 comprises a base 194 with a pair of walls 196A, 196B extending from base 194 to form a space 197 therebetween. Walls 196 comprise a pair of hooked arms 198A, 198B forming an opening 200 therebetween. Receptacle 192 may also comprise one or more optional branches 202 (in the illustrated embodiment there are two branches 202A, 202B) extending from base 194 to engage protrusion 162 when connection 150 is formed.

Figure 4B:
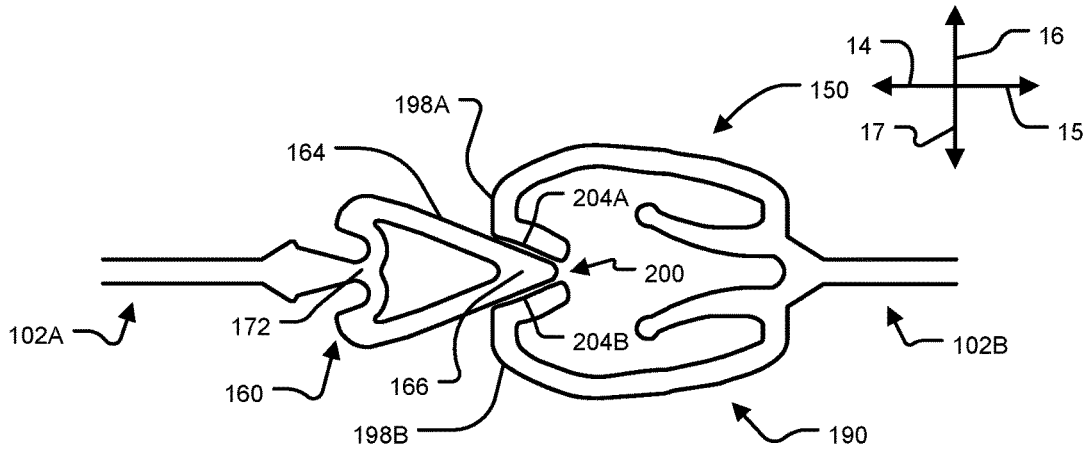

FIGS. 4B to 4F show various further stages in the process of forming connection 150 between first connector component 160 and second connector component 190. FIG. 4B shows first connector component 160 as it begins to engage second connector component 190. Narrow end 166 of tapered head 164 enters into opening 200 of receptacle 192 between hooked arms 198. As a result, hooked arms 198 and/or walls 196 begin to resiliently deform inwardly and outwardly (e.g. in directions 16, 17) due to the force applied by protrusion 162. This deformation results in opening 200 being widened. In the illustrated embodiment, beveled surfaces 204A, 204B of hooked arms 198 are shaped to complement similarly beveled surfaces of tapered head 164, thereby facilitating the insertion of protrusion 162 into opening 200 of receptacle 192 and the corresponding widening of opening 200 due to deformation of arms 198 and/or walls 196.

Figure 4C:
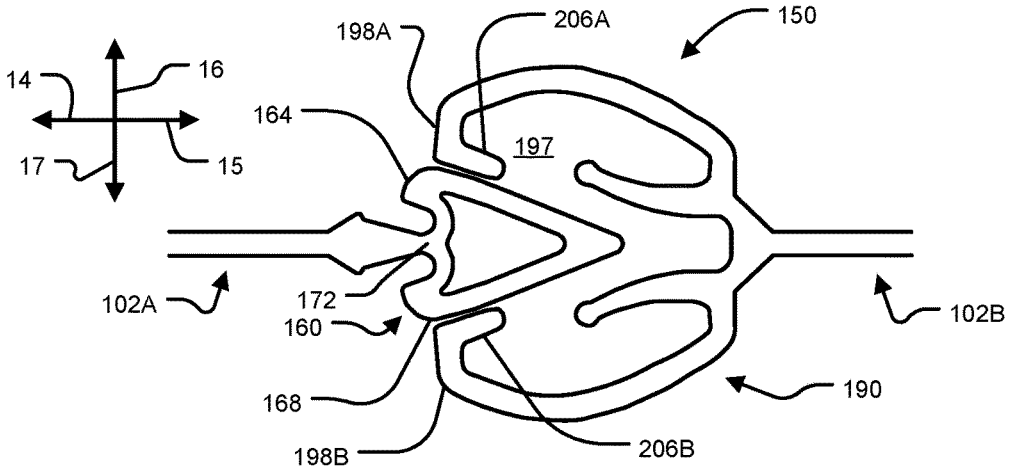
Figure 4D:
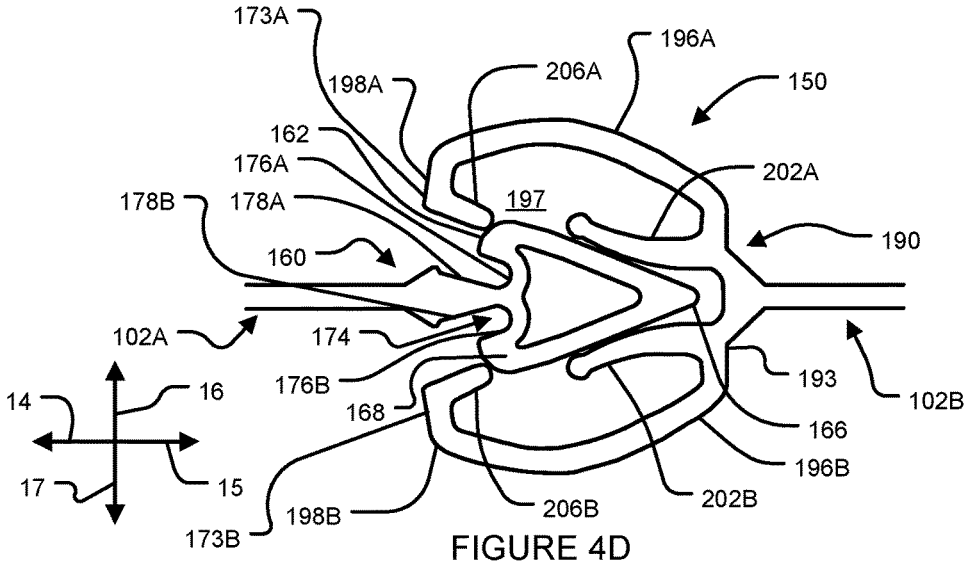

FIG. 4C shows protrusion 162 further inserted into receptacle 192 and space 197 to near the maximum width of wide end 168 of protrusion 162. This further insertion of protrusion 162 deforms walls 196 and hooked arms 198 even further as beveled surfaces 204 are displaced by tapered head 164. Hooked arms 198 continue to be forced apart from one another until wide end 168 of protrusion 162 has passed by the tips 206A, 206B of hooked arms 198 and into space 197. As shown in FIG. 4D, hooked arms 198 begin to resiliently snap back around protrusion 162 into a locked position once tips 206 of hooked arms 198 pass wide end 168 of protrusion 162. At around the same stage, narrow end 166 reaches optional branches 202 of the illustrated embodiment and narrow end 166 begins to deform branches 202 towards walls 196. This deformation results in branches 202 applying a restorative deformation force against protrusion 162 in direction 14 (parallel to a transverse edge of panels 102 which is orthogonal to the longitudinal edges (into and out of the page in the FIG. 4 views)). This force helps to secure the connection 150 by forcing wide end 168 of protrusion 162 against hooked arms 198 as described in more detail below.

In the locked position of some embodiments, hooked arms 198 engage a locking portion 174 of first connector component 160. In the FIG. 4 embodiment, locking portion 174 comprises concavities 176A, 176B that are shaped to receive tips 206 (see FIGS. 4D and 4E) of hooked arms 198. The extension of tips 206 into concavities 176 secures, or locks, connection 150 by providing an obstacle that hinders hooked arms 198 from being moved away from one another and releasing protrusion 162 and hinders first connector component 160 from being withdrawn from second connector component 190 (e.g. in transverse directions 14, 15).

Figure 4E:
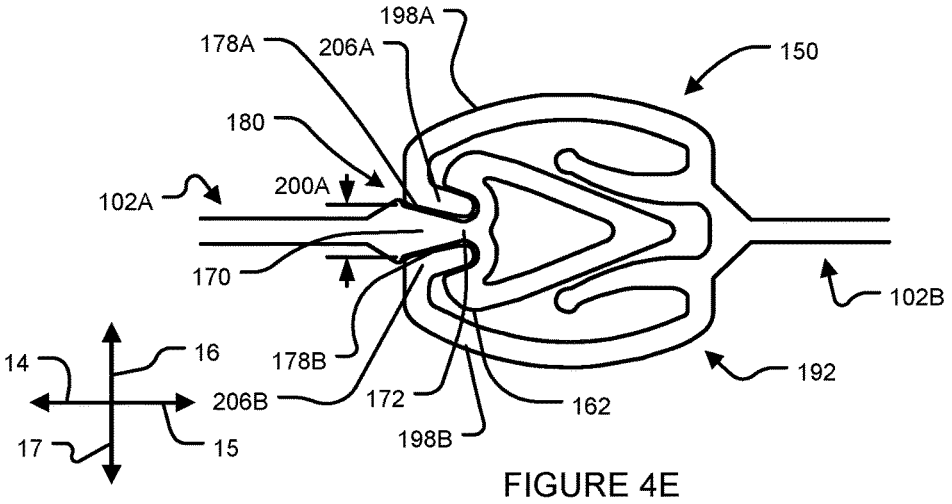

Once hooked arms 198 reach the locked configuration, they may abut a plug 170 located adjacent to the protrusion base 172 for plugging opening 200, as shown in FIG. 4E and described in more detail below. The abutment of hooked arms 198 with plug 170 provides further sealing engagements for completing connection 150 between first connector component 160 and second connector component 190. In the FIG. 4E embodiment, hooked arms 198 may not return to their original shapes once edge-to-edge connection 150 is formed—i.e. hooked arms 198 may remain partially deformed when connection 150 is made. Due to the width of plug 170, opening 200A between hooked arms 198 is larger than opening 200 of receptacle 192 in its undeformed state (as seen by comparing FIGS. 4A and 4E, for example). Because hooked arms remain partially deformed, hooked arms 198 may apply restorative deformation forces to protrusion 162, in effect squeezing plug 170.

Figure 4F:
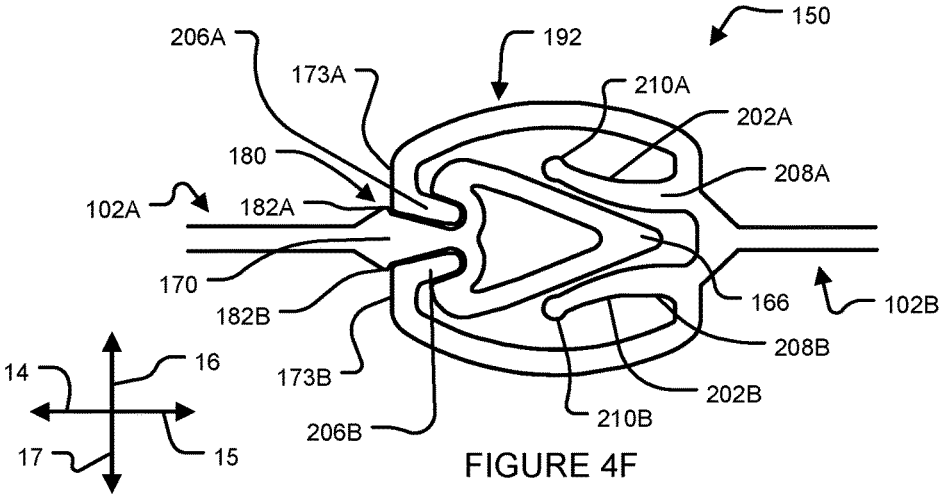

The locked configuration of connection 150 is supplemented by restorative deformation forces applied to protrusion 162 by optional branches 202A, 202B. FIG. 4F shows connection 150 in the same position as FIG. 4E. Each branch 202A, 202B comprises a base (208A, 208B) and a tip (210A, 210B). Bases 208, being located relatively nearer to receptacle base 194, may be relatively less resiliently deformable than tips 210. Tips 210 may be relatively more resiliently deformable than bases 208. In the illustrated embodiment, tips 210 have convex curvature on their distal surfaces and may engage tapered head 164 when protrusion 160 is extended into receptacle 192. As shown in FIG. 4F, branches 202 are curved such that tips 210 are further apart from one another than bases 208.

As described above, branches 202 are engaged by narrow end 166 as connection 150 approaches the locked position. Due to the tapered shape of narrow end 166 and/or the curved shape of tips 210, branches 202 may be forced to deform away from one another as protrusion 162 is extended further into receptacle 192. Because a greater proportion of branches 202 are deformed the further protrusion 162 is extended into receptacle 192, the restorative deformation forces acting against protrusion 162 in direction 14 (parallel to the transverse edges of panels 102) are correspondingly increased. These restorative deformation forces of branches 202 act to force protrusion 162 towards tips 206 in direction 14, further securing connection 150.

In some cases, tips 206 of hooked arms 198 may become caught on protrusion 162 as wide end 168 passes by hooked arms 198, hindering the completion of connection 150. The resilient deformation forces of branches 202 may remedy this situation by forcing protrusion 162 back in transverse direction 14 against tips 206. Because, in the illustrated embodiment, wide end 168 has already passed tips 206, the force of branches 202 will tend to force tips 206 to slide into concavities 176 and complete connection 150.

Returning to plug 170 as shown in FIGS. 4E and 4F. Plug 170 is shaped to complement opening 200 between hooked arms 198. That is, plug 170 widens from a narrowest point at protrusion base 172 through a tapered portion 178 and culminates in a sealing portion 180. Tapered portion 178 may have an angle that matches the angle of beveled surfaces 204 of tips 206 to create a large contact surface between protrusion 162 and receptacle 192 and minimize gaps therebetween. Plug 170 also comprises a sealing portion 180 for providing a sealing surface that extends past opening 200 away from a center line of protrusion 162. In the illustrated embodiment, sealing portion 180 comprises two wings 182A, 182B that extend from panel 102A and abut shoulders 173A, 173B of hooked arms 198. Sealing portion 180 may hinder protrusion 162 from being extended into receptacle 192 further than desired because wings 182 abut against hooked arms 198. Wings 182 may also prevent gapping of connection 150 when panels 102A and 102B are bent relative to one another.

Figure 5:
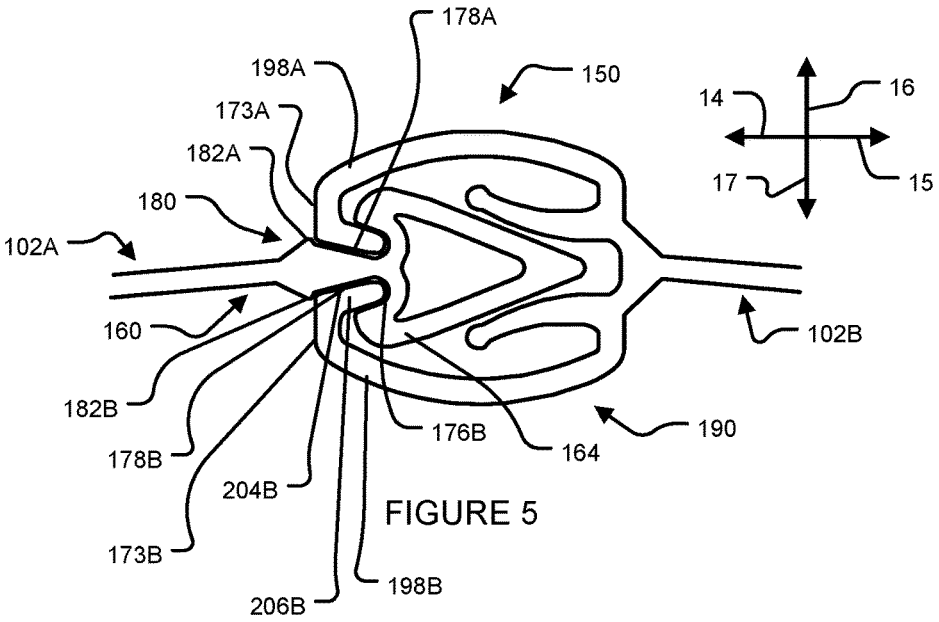
FIG. 5 is a partial top plan view of the FIG. 3 connection in which the panels have been bent.

For example, FIG. 5 shows connection 150 of the FIG. 4 embodiment in the locked position wherein the panels 102A, 102B have been bent (e.g. to make the curved lining system 100 shown in FIG. 2). Wings 182 generally remain proximate to hooked arms 198 when panels 102A, 102B are bent. Wing 182B abuts shoulder 173B of hooked arm 198B and beveled surface 204B of hooked arm 198B abuts against complementary beveled surface 178B on tapered portion of plug 170 as tip 206B projects into, and abuts against the end of, concavity 176B. This configuration generally constrains the end of hooked arm 198B (e.g. tip 206B) and wing 182B against movement relative to one another in each of directions 14, 15, 16 and 17. As a result, wing 182A may only move away from hooked arm 198A to the extent that plug 170 is deformed when panels 102A and 102B are bent. Since plug 170 is thicker than other parts of panels 102A, 102B, deformation of plug 170 is relatively unlikely, thereby reducing the formation of gaps between first connector component 160 and second connector component 190.

The particular elements and shape of the elements of first connector component 160 and second connector component 190 may be varied in numerous ways. For example, tapered head 164 may be heart-shaped, may have curved walls, may be stepped, may be jagged, or the like. Hooked arms 198 may be smoothly curved, angular, stepped, jagged or the like. In some embodiments, hooked arms 198 of second connector component 190 are not necessary and walls 196 may extend to engage protrusion 162 of first connector component 160 and to apply restorative deformation forces thereto. In such embodiments, walls 196 may have members (similar to branches 202) extending into the center of receptacle 192 that lock protrusion 162 into receptacle 192, and locking portion 174 may be located between wide end 168 and narrow end 166, for example.

Some example embodiments may comprise one branch 202. In these embodiments, branch 202 may have the same configuration as described above or may have other configurations such as a resiliently deformable loop extending from receptacle base 194 or hooks having hook concavities which open toward (or away from) receptacle base 194. In other example embodiments, sealing portion 180 may have various shapes. For example, sealing portion 180 may comprise a continuation of hooked arms 198 such that wings 182 extend further outward to form a relatively continuous surface. In other embodiments, sealing portion 180 may be longer and extend further into panel 102.

Figure 6:
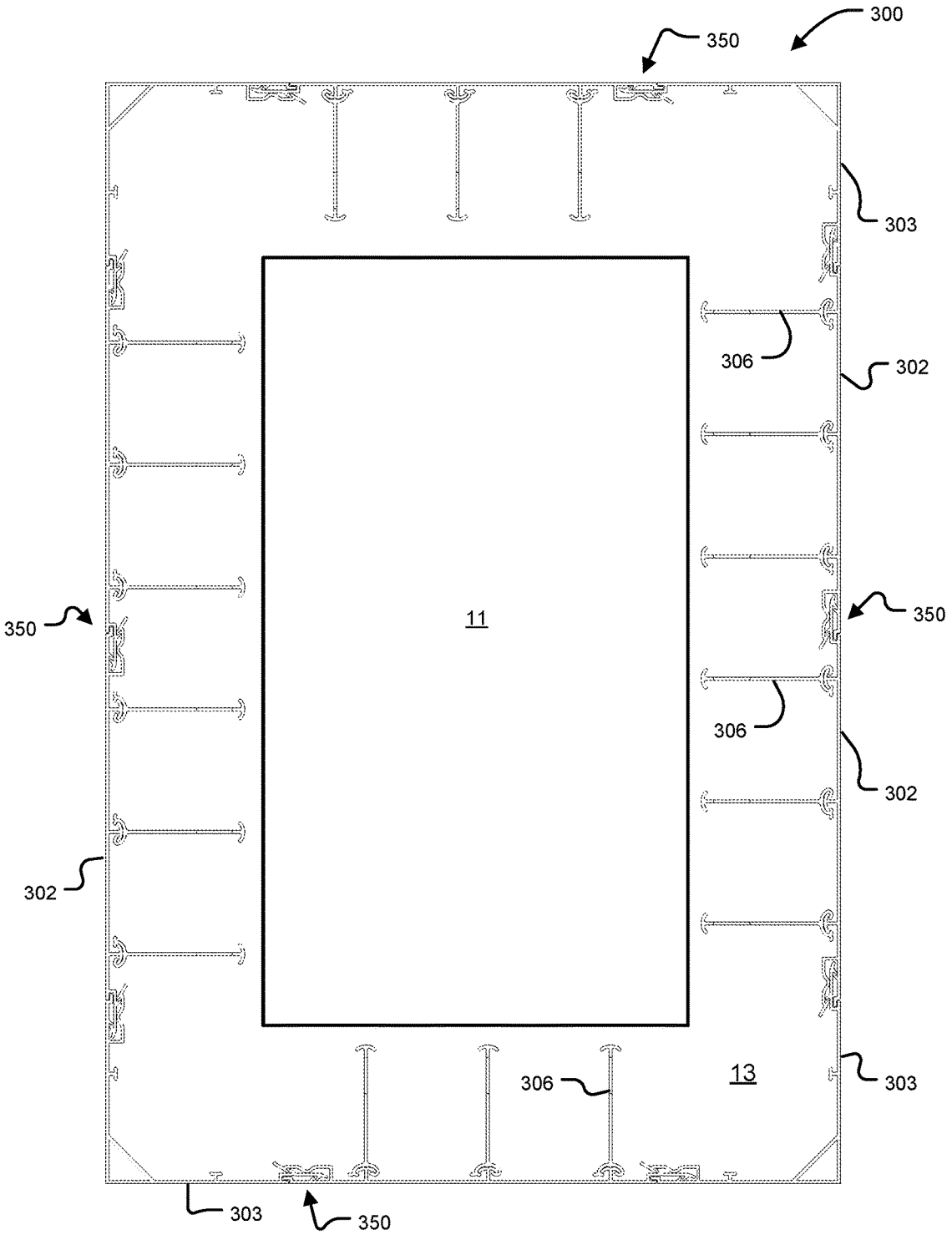
FIG. 6 is a cross sectional view of an example stay-in-place lining system for repairing an existing structure according to a particular embodiment.

FIG. 6 shows another embodiment of a stay-in-place lining system 300 for repairing an existing structure 11 with a lined (or cladded) repair structure formed of concrete or other curable material. Lining system 300 is similar in many respects to lining system 100 described herein and may be fabricated, used and/or modified in manners similar to those described herein for system 100. Lining system 300 comprises a number of panels 302 connected in edge-to-edge relationship along their longitudinal edges (not specifically labeled) by edge-to-edge connections 350. Lining system 300 also comprises a number of standoffs 306, which may space panels 302 away from existing structure 11 to form a space 13. To form the repair structure, concrete (or other curable material) may be introduced into space 13 between panels 302 and existing structure 11 and cured so that standoffs 306 are embedded in the concrete and lining system 300 (together with the cured concrete in space 13) forms a lined (or cladded) repair structure around existing structure 11. In the illustrated embodiment, lining system 300 and the resultant repair structure extend around a perimeter of existing structure 11. This is not necessary, however, and in some embodiments, lining systems and resultant repair structures may be used to repair a portion of an existing structure.

In some embodiments, lining system 300 may also be used as a formwork (or a portion of a formwork) to retain concrete or other curable material as it cures in space 1 between existing structure 11 and lining system 300. In some embodiments, lining system 300 may be used with an external formwork (or external bracing (not shown) which supports the lining system 300 while concrete or other curable material cures in space 13. The external formwork may be removed and optionally re-used after the curable material cures. In some embodiments, lining system 300 may be used (with or without external formwork or bracing) to fabricate independent structures (i.e. structures that do not line existing structures and are otherwise independent of existing structures).

Figure 7A:
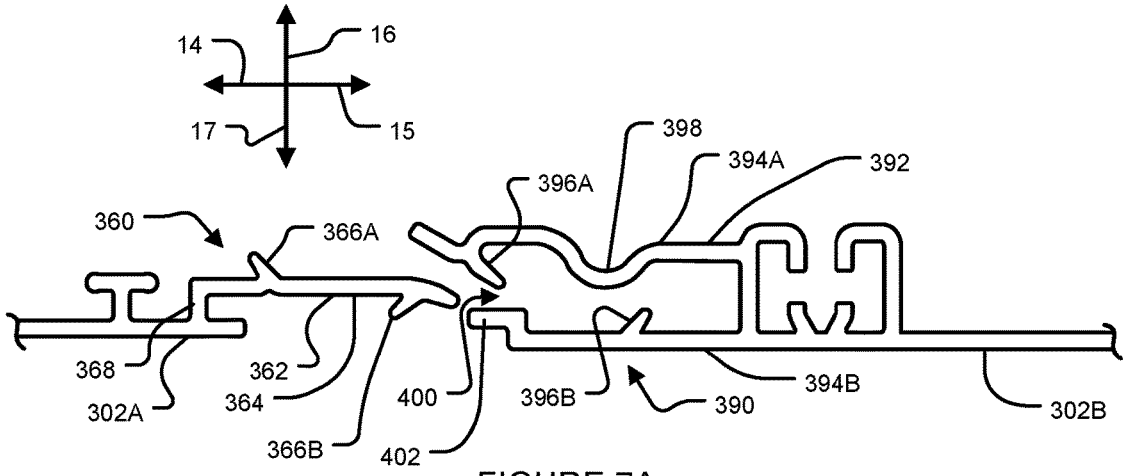
FIGS. 7A to 7E are partial top plan views of the connection process of an example edge-to-edge connection between a pair of panels of the FIG. 6 lining system.

FIGS. 7A-7E are partial top plan views of the connection process of an example connection 350 between first connector component 360 of panel 302A and second connector component 390 of panel 302B. In the illustrated embodiment, connection 350 is inwardly offset from the plane of panels 302 (e.g. in a direction toward existing structure 11), allowing for a relatively even exterior panel surface when connection 350 is formed (FIG. 7E) and adjacent panels 302A, 302B are connected. Such offset is not necessary. In some embodiments, connector components 360, 390 may be centered in the plane of panels 302A, 302B. To form connection 350, first connector component 360 of panel 302A is forced in direction 15 into second connector component 390 of panel 302B. FIG. 7A shows first connector component 360 and second connector component 390 prior to edge-to-edge connection 350 being formed. In the illustrated embodiment, first connector component 360 comprises a protrusion 362 having a stem 364 and barbs 366A, 366B. Barbs 366 extend from stem 364 at spaced apart locations on stem 364 and stem 364 extends away from a base 368. It can be seen from FIG. 7A that barbs 366 extend toward base 368 as they extend away from stem 364 and that barbs 266 extend inwardly and outwardly (directions 16, 17) from stem 364 (i.e. from opposing sides of stem 364) In some embodiments, different numbers of barbs 366 may extend from stem 364 and such barbs 366 may extend inwardly and outwardly from stem 364 at spaced apart locations.

Second connector component 390 comprises a receptacle 392 shaped to complement and receive protrusion 362. Receptacle 392 comprises walls 394A, 394B each having a catch 396A, 396B extending into receptacle 392 and in direction 15 at spaced apart locations to engage spaced apart barbs 366A, 366B of first connector component 360. Receptacle 392 forms an opening 400 between catch 396A and a finger 402. Receptacle 392 also comprises a securing protrusion 398 that extends into receptacle 392 and engages protrusion 362 to secure it between catches 396A, 396B. As barb 366A and catch 396A and barb 366B and catch 396B extend in similar orientations to one another, barbs 366 are able to slide past catches 396 as panel 302A moves relative to panel 302B in direction 15. Once connection 350 is formed, barbs 366 extend into concavities behind catches 396 and catches extend into concavities behind barbs 366, such that panel 302A is hindered from moving relative to panel 302B in transverse direction 14. In some embodiments, barbs 366 and catches 396 have an angle of between 30 and 60 degrees relative to the plane of panels 302.

Figure 7B:
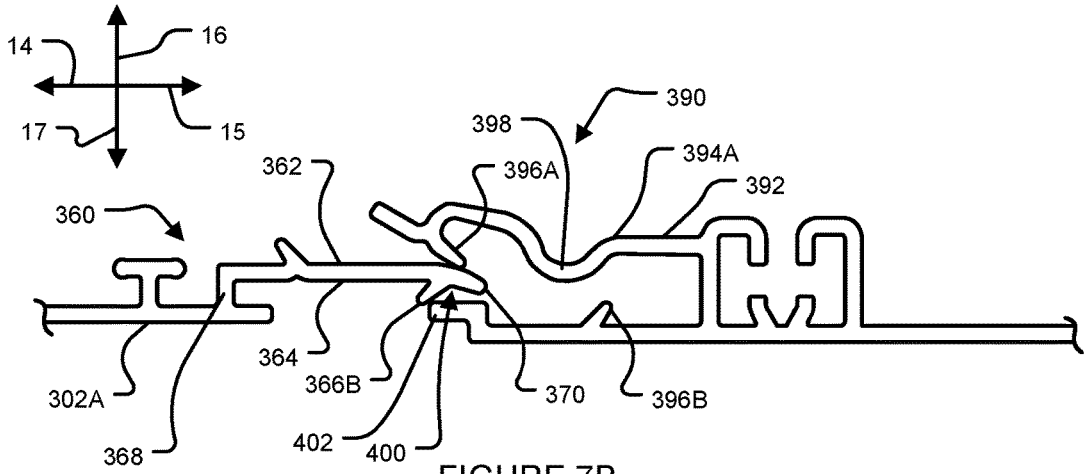

FIGS. 7B to 7E show various further stages in the process of forming connection 350 between first connector component 360 and second connector component 390. FIG. 7B shows first connector component 360 as it begins to engage second connector component 390. A tip 370 of protrusion 362 first engages catch 396A of receptacle 392. In the illustrated embodiment, tip 370 is slightly beveled in a direction similar to the extension of catch 396A to facilitate tip 370 sliding past catch 396A into opening 400 between catch 396A and finger 402 of receptacle 392. In some embodiments, tip 370 may have an angle of between 0 and 45 degrees relative to stem 364. In some embodiments, tip 370 may have an angle of between 5 and 20 degrees relative to stem 364.

As shown in FIG. 7B, catch 396A is displaced in direction 16 by tip 370 as barb 366B engages finger 402 of receptacle 392. This displacement results in resilient deformation of wall 394A and expansion of opening 400. The sliding of barb 366B over finger 402 is facilitated by barb 366B extending toward base 368 of protrusion 362 and away from tip 370 (i.e. in transverse direction 14) as barb 366B extends away from stem 364. In some embodiments, the sliding of tip 370 and/or barb 366B past catch 396A and FIG. 402 may cause some resilient deformation of wall 394B and corresponding displacement of finger 402 in direction 17.

Figure 7C:
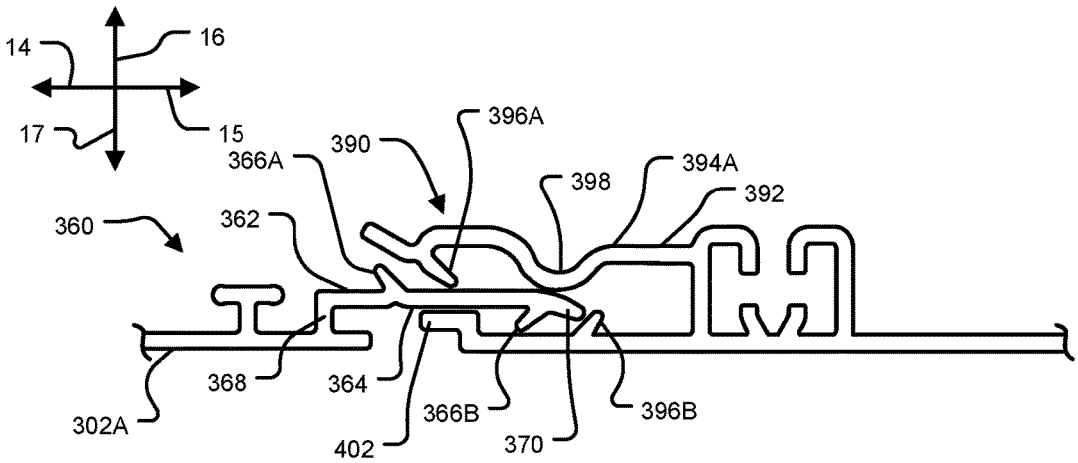
Figure 7D:
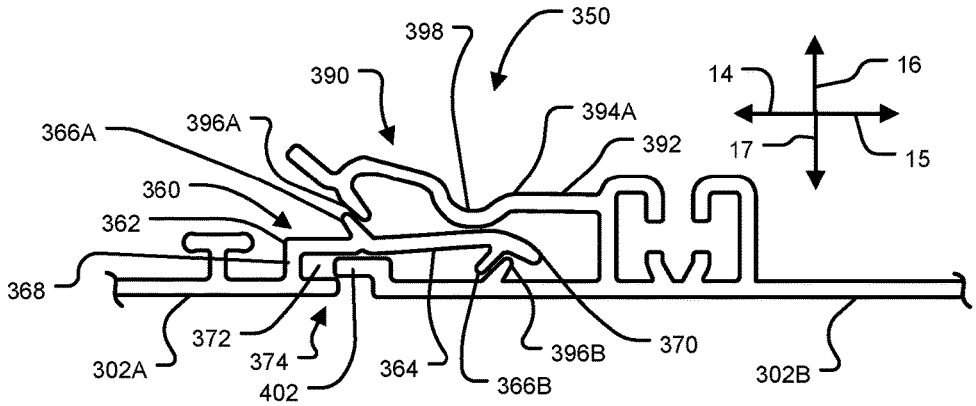

As protrusion 362 is extended further into receptacle 392, tip 370 engages securing protrusion 398 (as shown in FIG. 7C). Because tip 370 and barb 366B have passed through opening 400 and beyond finger 402, wall 394A (and potentially wall 394B) return toward their undeformed states and may contact stem 364 of protrusion 362. As the connection process moves past this intermediate stage, tip 370 and barb 366B contact catch 396B and barb 366A contacts catch 396A, as shown in FIG. 7D. The interaction between barb 366A and catch 396A and barb 366B and catch 396B may cause resilient deformation of both wall 394A and stem 364 in direction 16 and/or wall 394B in direction 17. This allows each of barbs 366A, 366B to move past catches 396A, 396B into receptacle 392 to form connection 350. In the illustrated embodiment, securing protrusion 398 is shaped as an indentation in wall 394A, which may facilitate the resilient deformation of wall 394A by providing an area more susceptible to bending (i.e. resilient deformation). Also, securing protrusion 398 may force stem 364 in direction 17 to help catch 396B engage barb 366B when connection 350 is made. In other embodiments, securing protrusion 398 may be provided by a thickening of wall 394A and a corresponding protrusion which extends into receptacle 392. At about the stage shown in FIG. 7D, finger 402 of second connector component 390 begins to enter concavity 372 of first connector component 360. Together, finger 402 and concavity 372 provide a finger lock 374 between first connector component 360 and second connector component 390. Finger lock 374 provides a relatively even external surface between panels 302A and 302B. An even surface between panels of connection 350 may provide a suitable surface for additional coverings such as paint, wallpaper, sealant and/or the like.

Figure 7E:
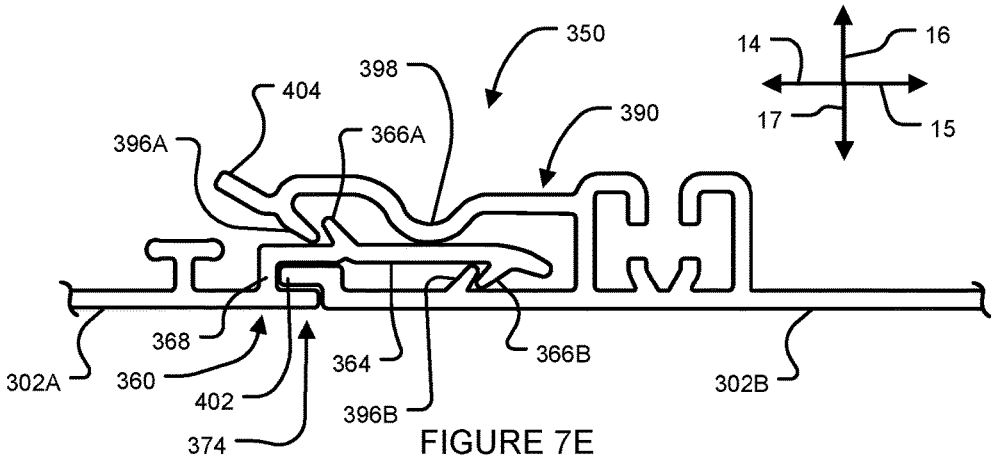

FIG. 7E shows completed connection 350. Barb 366A has passed catch 396A, barb 366B has passed catch 396B and securing protrusion 398 engages stem 364. In some embodiments, catch 396A and securing protrusion 398 apply restorative deformation forces to protrusion 362. This may be because stem 364 prevents wall 394A (and catch 396A and securing protrusion 398) from returning to their original, undeformed, shapes.

When connection 350 is completed, the interaction between barbs 366A, 366B and catches 396A, 396B prevent first connector component 360 from moving relative to second connector component 390 in transverse direction 14 and thereby disengaging from second connector component 390. Also, securing protrusion 398 may prevent barb 366B from slipping over catch 396B if, for example, panels 302A and 302B are bent relative to one another. As mentioned, securing protrusion 398 applies a restorative deformation force in direction 17 to stem 364, thereby hindering disengagement of barb 366B and catch 396B.

FIG. 7E also shows completed finger lock 374 with finger 402 fully engaged in concavity 372. As shown, finger 402 is offset from the exterior plane of panel 302B. In addition to providing an even or smooth surface between panels 302A and 302B, finger lock 374 may strengthen connection 350 by providing additional contact surfaces and constraints between first connector component 360 and second connector component 390. Finger lock 374 may also reduce the formation of gaps when forces are applied to connection 350.

In the illustrated embodiment, second connector component 390 also comprises a tab 404 located proximate catch 396A at an end of wall 394A (see FIG. 7E). Tab 404 allows for connection 350 to be disengaged by permitting a user to apply a force in direction 16 to tab 404, causing resilient deformation of wall 394A and allowing barbs 366A, 366B to be disengaged from catches 396A, 396B. Once barbs 366A, 366B are disengaged from catches 396A, 396B, protrusion 362 may be removed from receptacle 392, finger lock 374 may be disengaged and first connector component 360 may be disengaged from second connector component 390.

The particular elements and shape of the elements of first connector component 360 and second connector component 390 may be varied in numerous ways. For example, the angle of barbs 366 and catches 396 may vary from 5 degrees to 85 degrees. Also, in some embodiments, barbs 366 and/or catches 396 may comprise surfaces that are rough, jagged, adhesive or the like to strengthen the engagement between barbs 366 and catches 396. In some embodiments, barbs 366 and/or catches 396 may comprise hooks shaped to engage the corresponding barbs 366 and/or catches 396. In some embodiments, securing protrusion 398 may extend from wall 394A (as opposed to being an indentation thereof as shown in, for example, FIG. 7E). In some embodiments, a securing protrusion 398 may additionally or alternatively be provided on wall 394B. In some embodiments, protrusion 362 may comprise a complementary connector for engaging securing protrusion 398 such as an indentation, hook, protrusion or the like. In some embodiments, finger lock 374 may comprise hooks, jagged surfaces, or other connection mechanisms. In some embodiments, finger lock 374 is not necessary.

In other respects lining system 300 is similar to lining system 100 described herein. In particular, lining system 300 may be fabricated, used and modified in manners similar to lining system 100 described herein. Lining system 100 is shown (in FIG. 2) in use to fabricate a repair structure that is curved for use in repairing an existing structure 30 which has a generally curved surface. Lining system 300 is shown (in FIG. 6) in use to fabricate a repair structure that has flat portions and angled corners (e.g. is rectangular) for use in repairing an existing structure 11 which has flat portions and angled corners (e.g. is rectangular). In general, lining system 100 may additionally or alternatively be used to fabricate a repair structure that has flat portions and angled corners for use in repairing an existing structure which has flat portions and angle corners (e.g. is rectangular). In such embodiments, lining system 100 may be provided with corner panels similar to corner panels 303 of lining system 300 except that the panels may have connector components 160, 190 on their ends. In general, lining system 300 may additionally or alternatively be used to fabricate a repair structure that is curved for use in repairing an existing structure which has a generally curved surface. While not explicitly shown in the illustrated embodiments, either of lining systems 100, 300 described herein may be used to fabricate a repair structure having inside corners. Such lining systems may comprise inside corner panels similar to outside corner panels 303, but with suitable connector components at their opposing edges.

Figure 8:
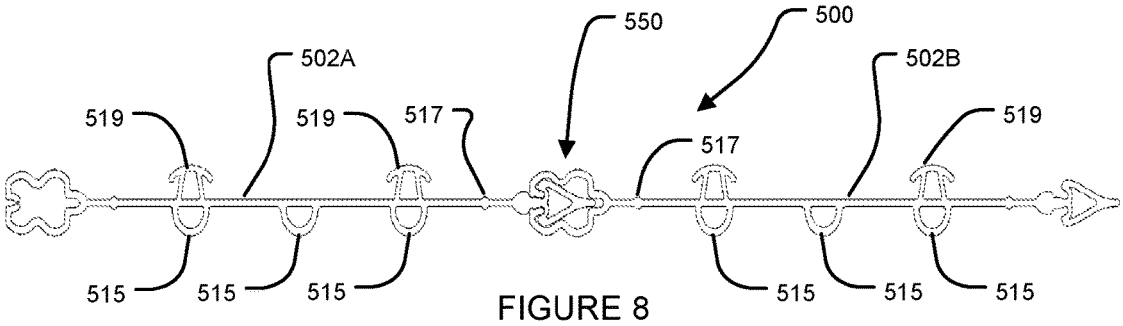
FIG. 8 is a top plan view of an edge-to-edge connection between a pair of panels of an example lining system according to a particular embodiment.

FIG. 8 shows a pair of panels 502A, 502B of a lining system 500 according to another embodiment. Panels 502 and lining system 500 are similar to panels 102, 302 and lining systems 100, 300 described herein and may be fabricated, used and/or modified in manners similar to panels 102, 302 and lining systems 100, 300 described herein. By way of non-limiting example, lining system 500 may be used to fabricate a lined repair structure on a curved surface of an existing structure (similar to lining system 100 on existing structure 30 of FIG. 2), to fabricate a lined repair structure on a flat surface of an existing structure or a flat surface of an existing structure incorporating corners (similar to lining system 300 on existing structure 11 of FIG. 6 (in which case system 500 may be provided with suitable corner panels similar to corner panels 303)) and/or to fabricate an independent structure.

Lining system 500 comprises a number of panels 502 (like panels 502A, 502B) connected in edge-to-edge relationship along their longitudinal edges by edge-to-edge connections 550. While not expressly shown in FIG. 8, lining system 500 may comprise standoffs which are similar to, and connected to panels 502 in a manner similar to, standoffs 106 of lining system 100 and/or standoffs 302 of lining system 300. Such standoffs may serve to space panels 502 away from existing structures and to form spaces therebetween.

Lining system 500 and panels 502 differ from lining systems 100, 300 and panels 102, 302 primarily in the connector components 560, 590 which are used to make edge-to-edge connections 550. FIGS. 9A to 9F are partial top plan views of the process of forming a connection 550 between a pair of panels 502A, 502B of the FIG. 8 lining system and, more particularly, between a first connector component 560 of panel 502A and a second connector component 590 of panel 502B. To form connection 550, first connector component 560 is forced in direction 15 toward and into second connector component 590.

Figure 9A:
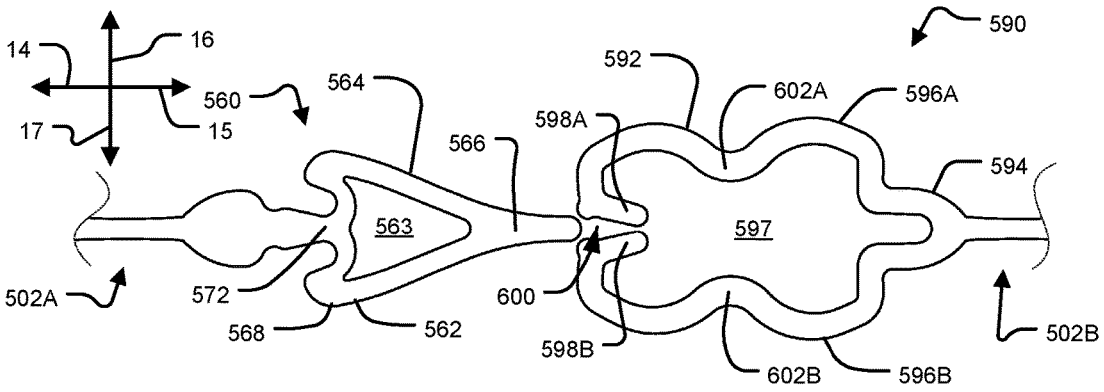
FIGS. 9A to 9F are partial top plan views of the connection process of the FIG. 8 connection.

FIG. 9A shows first connector component 560 and second connector component 590 prior to the formation of edge-to-edge connection 550. In the illustrated embodiment, first connector component 560 comprises a protrusion 562 having a tapered head 564 with a narrow end 566 at the tip and a wide end 568 near the base 572 of protrusion 562. In the FIG. 9 embodiment, protrusion 562 is generally arrowhead shaped and is hollow with a space 563 formed therein. Space 163 is not necessary.

Second connector component 590 comprises a receptacle 592 shaped to complement and receive protrusion 562. Receptacle 592 comprises a base 594 with a pair of walls 596A, 596B extending from base 194 to form a space 597 therebetween. Walls 596 comprise a pair of hooked arms 598A, 598B forming an opening 600 therebetween. Receptacle 592 may also comprise one or more optional protrusions 602 (in the illustrated embodiment there are two protrusions 602A, 602B) which extend into space 597. In the illustrated embodiment, protrusions 602 comprise shaped indentations formed in walls 596A, 596B. In other embodiments, protrusions 602 may comprise convexities that extend from walls 596A, 596B into space 597 (e.g. thickened regions of walls 596A, 596B). As discussed in more detail below, protrusions 602 of second connector component 590 engage protrusion 562 of first connector component 560 when connection 550 is formed.

Figure 9B:
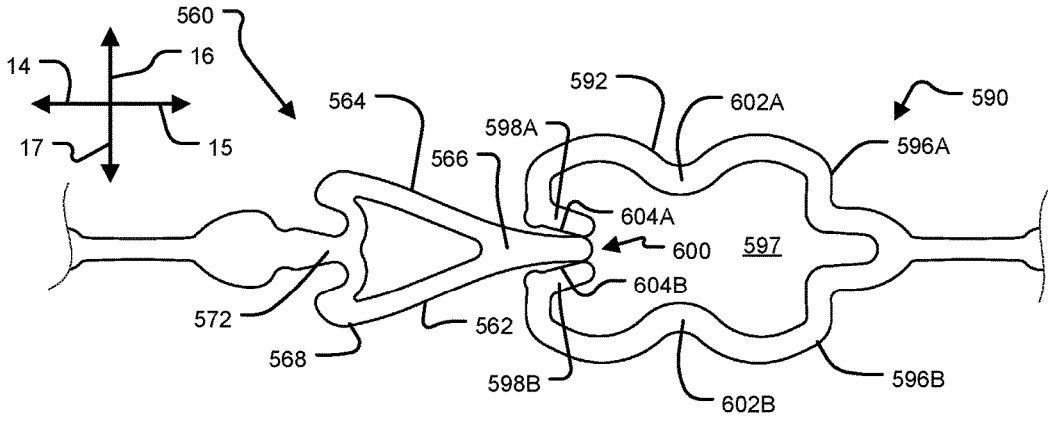

FIGS. 9B to 9F show various further stages in the process of forming connection 550 between first connector component 560 and second connector component 590. FIG. 9B shows first connector component 560 as it begins to engage second connector component 590. Narrow end 566 of tapered head 564 enters into opening 600 of receptacle 592 between hooked arms 598. As a result, hooked arms 598 and/or walls 596 begin to resiliently deform inwardly and outwardly (e.g. in directions 16, 17) due to the force applied by protrusion 562. This deformation results in opening 600 being widened. In the illustrated embodiment, beveled surfaces 604A, 604B (FIG. 9B) of hooked arms 598 are shaped to complement similarly beveled surfaces of tapered head 564, thereby facilitating the insertion of protrusion 562 into opening 600 of receptacle 592 and the corresponding widening of opening 600 due to deformation of arms 598 and/or walls 596.

Figure 9C:
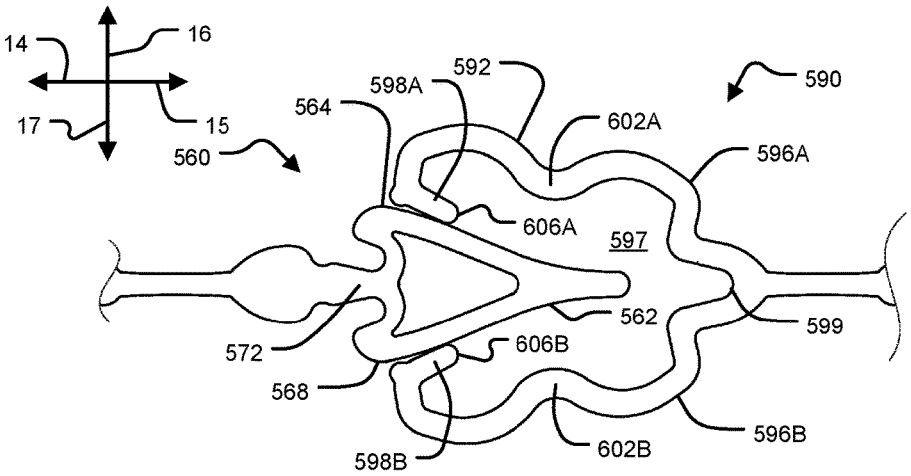

FIG. 9C shows protrusion 562 further inserted into receptacle 592 and space 597 to near the maximum width of wide end 568 of protrusion 562. This further insertion of protrusion 562 deforms walls 596 and hooked arms 598 even further as beveled surfaces 604 slide against corresponding beveled surfaces of tapered head 164 and are displaced by the widening of tapered head 164. Hooked arms 198 continue to be forced apart from one another until wide end 568 of protrusion 562 has passed by the tips 606A, 606B of hooked arms 598 and into space 597.

Figure 9D:
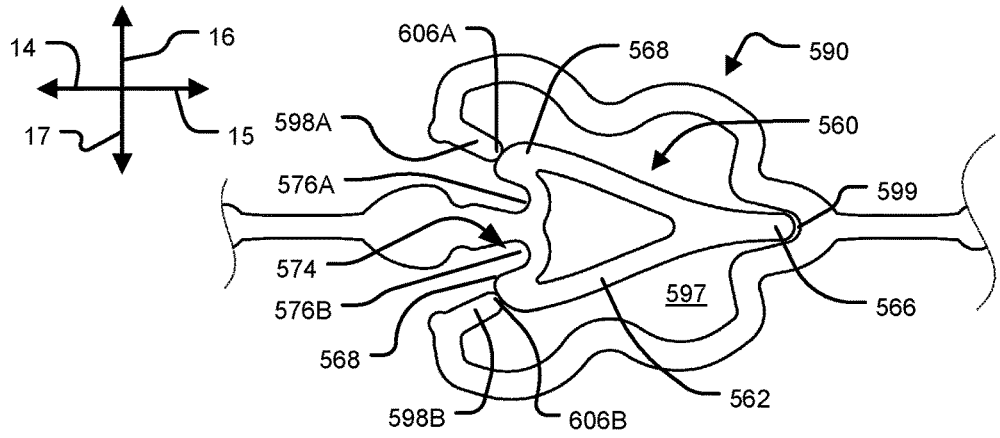

As shown in FIG. 9D, as protrusion 562 extends further into space 597, tip 566 of protrusion 562 enters concavity 599 of space 597 (which may be defined by walls 596). The walls of concavity 599 may act to guide tip 566 such that first connector component 560 remains properly aligned with second connector component 590 (e.g. such that their respective axes of bilateral symmetry are generally collinear).

Figure 9E:
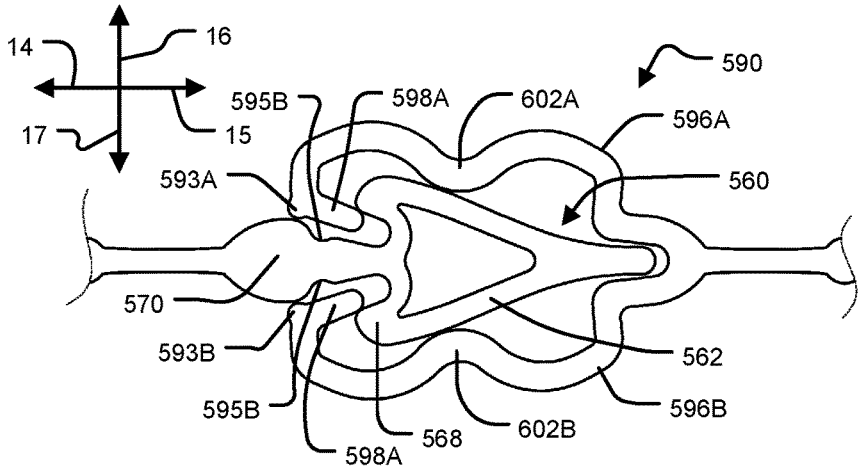

As is also shown in FIGS. 9D and 9E, hooked arms 598 begin to resiliently snap back around protrusion 562 into a locked position once tips 606 of hooked arms 598 pass wide end 568 of protrusion 562.

Figure 9F:
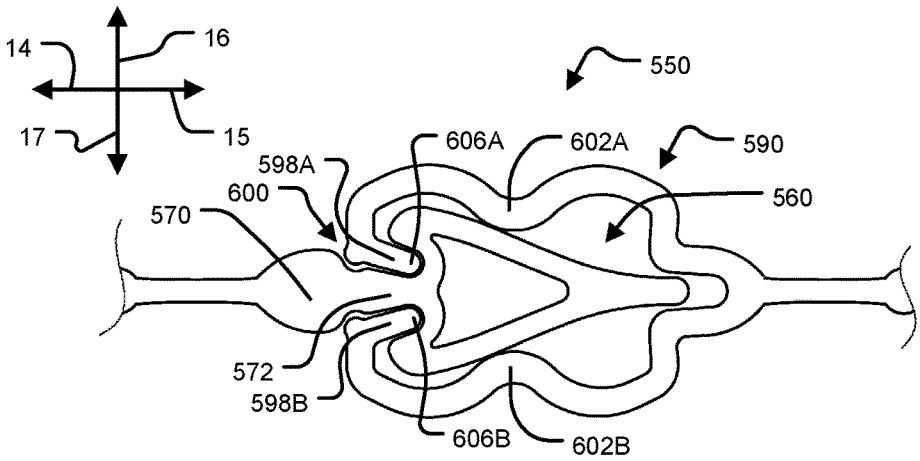

As shown in FIG. 9E, once hooked arms 598 have passed over the maximum width of wide end 568, walls 596 begin to resiliently snap back such that protrusions 602 of second connector component 590 contact protrusion 562 of first connector component 560. Through this contact, protrusions 602 apply restorative deformation force against protrusion 562 and, because of the shape of protrusion 562, this force is oriented in transverse direction 14 (e.g. parallel to the transverse edges of panels 502 which are generally orthogonal to the longitudinal edges extending into and out of the page in the FIG. 9 views). This force helps to secure the connection 150 by forcing wide end 568 of protrusion 562 against hooked arms 598 as described in more detail below In the locked position of some embodiments, hooked arms 598 engage a locking portion 574 of first connector component 560. In the FIG. 9 embodiment, locking portion 574 comprises concavities 576A, 576B (FIG. 9D) that are shaped to receive tips 606 (see FIG. 9D) of hooked arms 598. As shown in FIGS. 9E and 9F, the extension of tips 606 into concavities 576 secures, or locks, connection 550 by providing an obstacle that hinders hooked arms 598 from being moved away from one another and releasing protrusion 562 and hinders first connector component 560 from being withdrawn from second connector component 590 (e.g. by relative movement of panels 502A, 502B in directions 14, 15).

Once hooked arms 598 reach the locked configuration, they may abut a plug 570 located adjacent to the protrusion base 572 for plugging opening 600, as shown in FIG. 9F and described in more detail below. The abutment of hooked arms 598 with complementary surfaces of plug 570 provides further sealing engagements for completing connection 550 between first connector component 560 and second connector component 590. In the FIG. 9F embodiment, hooked arms 598 may not return to their original shapes once edge-to-edge connection 550 is formed—i.e. hooked arms 598 may remain partially deformed when connection 550 is made. Due to the width of protrusion base 572 and/or plug 570, opening 600 between hooked arms 598 is larger when connection 550 is complete than when first component connector 560 and second component connector 590 are separate (this can be seen by comparing FIGS. 9A and 9F). Because hooked arms 598 remain partially deformed, hooked arms 598 may apply restorative deformation forces to protrusion 562, in effect squeezing base 572 and/or plug 570.

In the FIG. 9 embodiment, hooked arms 598 comprise nubs 593A, 593B (FIG. 9E) and beveled surfaces 604A, 604B (FIG. 9B) at or near tips 606. Nubs 593 may be dimensioned to extend into complementary concavities 595 in plug 570, and beveled surfaces 604 may be shaped to abut against complementary beveled surfaces of plug 570, when connection 550 is in a locked configuration (as shown in FIG. 9F).

The locked configuration of connection 550 is supplemented by restorative deformation forces applied to protrusion 562 by optional protrusions 602A, 602B. Optional protrusions 602 may be formed by bends in the shape of walls 596, as shown in the FIG. 9 embodiment. Optional indentations 602 may additionally or alternatively be formed by bulges, convexities, protrusions or the like in walls 596—e.g. regions of walls 596 with relatively greater thickness.

In some cases, tips 606 of hooked arms 598 may become caught on protrusion 562 as wide end 568 passes by hooked arms 598, hindering the completion of connection 150. The resilient deformation forces caused by the interaction of protrusions 602 with the tapered body of protrusion 562 may remedy this situation by forcing protrusion 562 back in transverse direction 14 against tips 606. Because, in the illustrated embodiment, wide end 568 has already passed tips 606, the force caused by protrusions 602 will tend to force tips 606 to slide into concavities 576 and complete connection 150.

Panels 502 of the FIG. 8 embodiment also differ from panels 102, 302 in that panels 502 comprise curved stiffeners 515. In the FIG. 8 embodiment curved stiffeners 515 extend out from the main body of panel 502 and form double-walled regions which define hollow spaces between curved stiffeners 515 and the main body of panel 502. In some embodiments, there is no such hollow space and curved stiffeners 515 may comprise thickened regions of the main body of panel 502. Curved stiffeners 515 act to stiffen and provide enhanced structural integrity to panels 502. Curved stiffeners 515 may help resist the force exerted by a curable structural material against panel 502, and may thereby prevent undesired deformation (also known as "pillowing") of panel 502. In the illustrated embodiment, each panel 502 comprises three curved stiffeners 515. In some embodiments, panel 502 may be provided with different numbers of curved stiffeners 515 and this number may depend on such factors as the transverse dimension of panel 502, the amount of curable material being used for a particular application and/or the like. In the illustrated embodiment, curved stiffeners 515 are located opposite connector components 519 for connection to standoffs (not shown). This location of curved stiffeners 515 may help to structurally reinforce the connections between panel 502 and corresponding standoffs by minimizing deformation of panel 502 in the regions of such connections.

Panels 502 of the FIG. 8 embodiment also differ from panels 102, 302 in that panels 502 comprise thickened regions 517, where the main body of panel 502 is relatively thick in comparison to adjacent regions. Thickened regions 517 may have a stiffening effect similar to curved stiffeners 517 and may provide enhanced structural integrity to panels 502. In the FIG. 8 embodiment, thickened regions 517 are positioned adjacent to (or relatively close to) connector components 560, 590 and corresponding panel-to-panel connections 550. In particular embodiments, thickened regions 517 are located within a transverse distance from connector components 560, 590 that is less than the transverse dimensions of connector components 560, 590. In some embodiments, thickened regions 517 are located within a transverse distance from connector components 560, 590 that is less than ½ the transverse dimensions of connector components 560, 590. Because of this location of thickened regions 517, if panels 502 are bent (see, for example, the bending of panels 102 to fabricate the FIG. 2 repair structure), thickened regions 517 may prevent or reduce excessive bending of panels 502 near their connector components 560, 590 and may thereby help to maintain the integrity of edge-to-edge connections 550 in the face of such bending.

Figure 10:
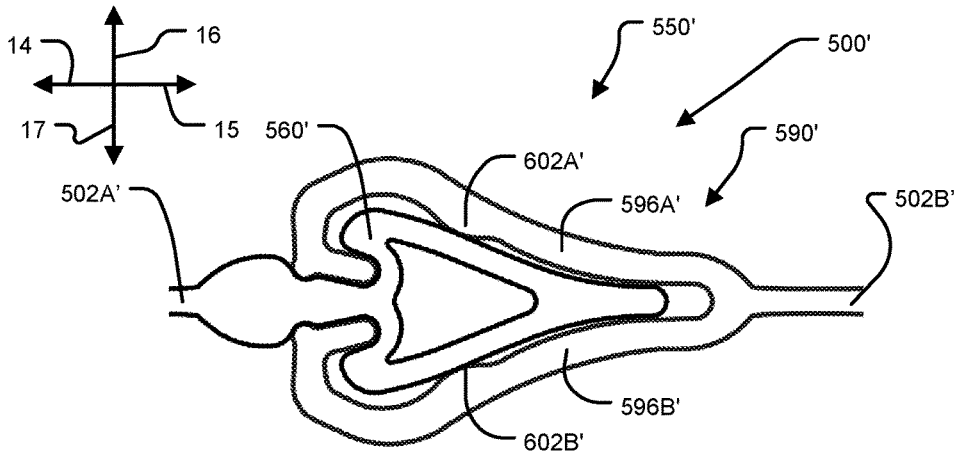
FIG. 10 is a partial top plan view of an edge-to-edge connection between a pair of panels of an example lining system according to a particular embodiment.
Figure 11:
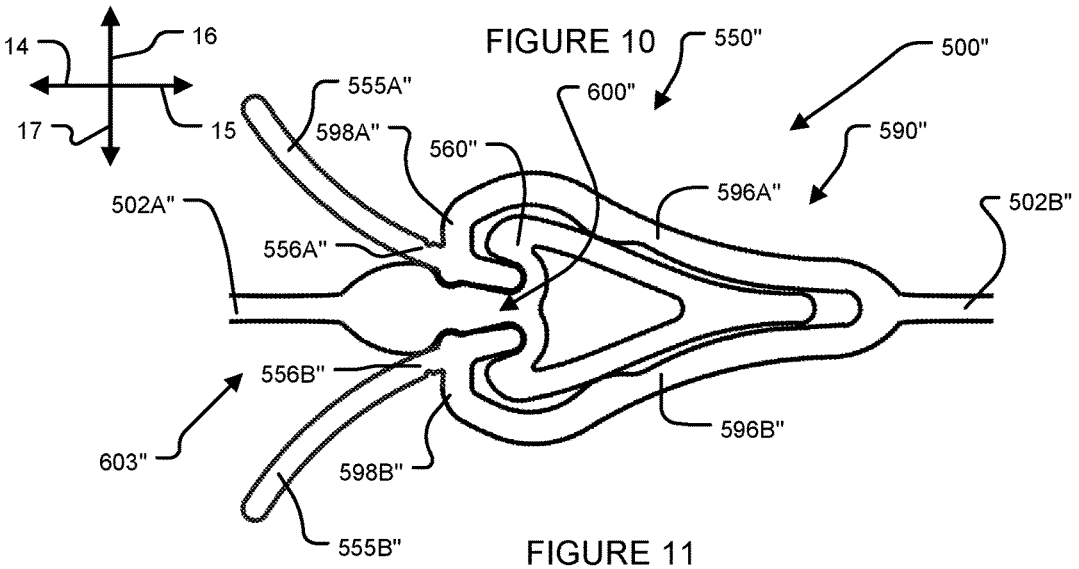
FIG. 11 is a partial top plan view of an edge-to-edge connection between a pair of panels of an example lining system according to a particular embodiment.

FIG. 10 is a partial top plan view of an edge-to-edge connection 550' between a pair of panels 502A', 502B' of an example lining system 500' according to a particular embodiment. Connection 550', panels 502A', 502B' and lining system 500' are similar to (and may be fabricated, used or modified in manners similar to) connection 550, panels 502A, 502B and lining system 500 described herein and shown in FIGS. 8 and 9. Connector component 560' of panel 502A' is substantially similar to connector component 560 of panel 502A. Connection 550' differs from connection 550 primarily in that connector component 590' of panel 502B' comprises protrusions 602A', 602B' in walls 596A', 596W, where protrusions 602' are formed from a relatively thicker portion of walls 596' (as opposed to being formed from indentations in walls 596 as is the case with protrusions 602 of connector component 590). Protrusions 602' of connector component 590' function in a manner similar to protrusions 602 of connector component 590 to reinforce connection 550'. Connection 550' also differs from connection 550 in that walls 596' of connector component 590' are shaped to conform relatively closely to the shape of connector component 560' which may help to guide connector component 560' as it protrudes into connector component 590'. In other respects, connection 550', panels 502A', 502B' and lining system 500' may be the same as connection 550, panels 502A, 502B and lining system 500 described herein FIG. 11 is a partial top plan view of an edge-to-edge connection 550" between a pair of panels 502A", 502W" of an example lining system 500" according to a particular embodiment. Connection 550", panels 502A", 502B" and lining system 500" are similar to (and may be fabricated, used or modified in manners similar to) connection 550, panels 502A, 502B and lining system 500 described herein and shown in FIGS. 8 and 9. Connector component 560" of panel 502A" is substantially similar to connector component 560 of panel 502A. Connection 550" differs from connection 550 in that connector component 590" of panel 502B" comprises protrusions 602" which are similar to protrusions 602' of connector component 590' (FIG. 10), in that arms 596A", 596B" have shapes similar to arms 596' of connector component 590' (FIG. 10) and in that connector component 590" comprises guide pieces 555A", 555B" extending from walls 596A", 596B" and curved arms 598A", 598B" which define opening 600".

Guide pieces 555" may make it easier to insert connector component 560" into opening 600" of connector component 590". More particularly, guide pieces 555" extend inwardly and outwardly (in directions 16, 17) from curved arms 598" in a region of opening 600" and thereby provide an opening 603" therebetween which is relatively wide in comparison to opening 600". It will be appreciated that with the relative width of opening 603", it may be easier to insert connector component 560" into opening 603" than into relatively narrow opening 600". Guide pieces 555" may be shaped to provide guide surfaces such that once connector component 560" is inserted into opening 603", guide pieces 555" guide connector component 560" into opening 600". Guide pieces 555" may be particularly useful in environments where aligning connector component 560" with connector component 590" may be difficult, such as low visibility environments, high wind environments, and underwater environments. In some embodiments, it is sufficient to provide a single guide piece 555" which provides a guide surface to guide connector component 560" into opening 600".

After connector component 560" is inserted into connector component 590", guide pieces 555" may be removed from panels 502". Guide pieces 555" may be removed by being cut off of walls 596", by being snapped off walls 596", and/or by other suitable means. Indentations 556A", 556B" may be provided in guide pieces 555", thereby providing weak spots at which guide pieces 555" may be bent to snap guide pieces off, providing guides for cutting guide pieces 555" off or for otherwise facilitating the removal of guide pieces 555" from panels 502". Indentations 556" may be additionally or alternative be provided on the sides of guide pieces 555" opposite the sides of guide pieces 555" shown in FIG. 11.

Figure 12:
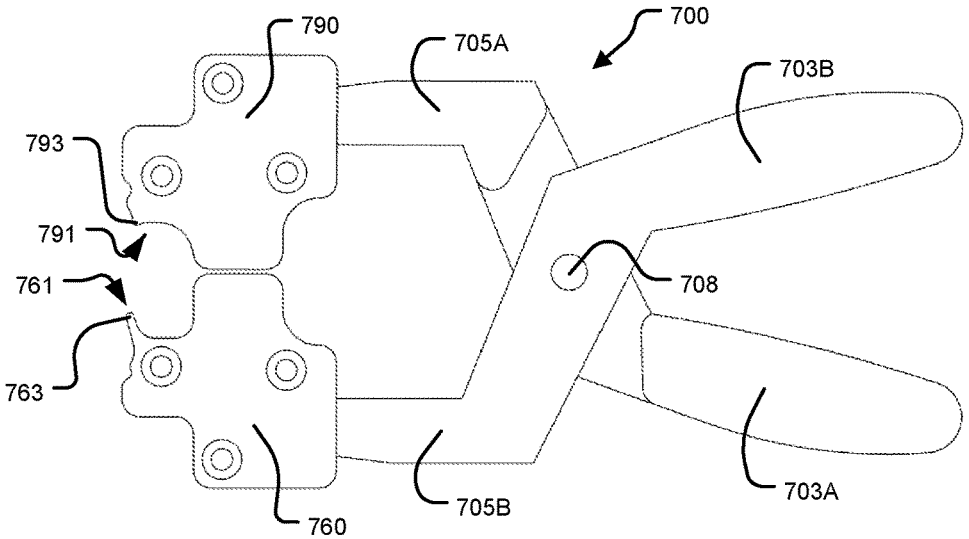
FIG. 12 is a top plan view of a tool which may be used to form the FIG. 3 connection.

FIG. 12 shows a tool 700 which may be used to insert connector component 160 into connector component 190 and to thereby make connection 150 (see FIGS. 4A-4F) between edge-adjacent panels 102A, 102B. Similar tools may be used with other types of connector components and other panels described herein.

In the illustrated embodiment, tool 700 comprises handles 703A, 703B which are connected to arms 705A, 705B, respectively. Arms 705A, 705 B are pivotally coupled to each other by pivot joint 708. Arm 705A is connected to tool head 790. Arm 705B is connected to tool head 760. Tool head 790 has a tool face 791 and tool head 760 has a tool face 761. Referring to FIGS. 4A-4F, tool face 791 is shaped and/or dimensioned to be able to exert force on (e.g. to form a complementary fit with or to otherwise engage) a portion of arm 196B which is furthest from opening 200. In the illustrated embodiment, tool face 791 comprises a protrusion 793 which extends into concavity 193 of connector component 190—see FIG. 4D. Tool face 761 is shaped and/or dimensioned to be able to exert force on (e.g. to form a complementary fit with or to otherwise engage) a portion of protrusion 164 furthest from narrow end 166. In the illustrated embodiment, tool face 761 comprises a protrusion 763 which extends into concavity 176B of connector component 160—see FIG. 4D.

Tool 700 may be used for form edge-to-edge connection 150 by carrying out the following steps: (1) move panels 102A, 102B into proximity with one another such that connector component 190 is adjacent to and aligned with connector component 160; (2) position tool 700 such that tool face 791 engages a portion of connector component 190 and tool face 761 engages a portion of connector component 160; (3) squeeze handles 703A, 703B together so that tool face 791 moves closer to tool face 761, thereby pushing connector component 160 into connector component 190; (4) repeat steps 1-3 as necessary at different points along longitudinal edge 104 to form edge-to-edge connection 150 (see, for example, FIG. 2). The pivoting action of tool 700 is not necessary. In some embodiments, tool 700 may comprise some other mechanism of forcing tool heads 760, 790 toward one another.

Processes, methods, lists and the like are presented in a given order. Alternative examples may be performed in a different order, and some elements may be deleted, moved, added, subdivided, combined, and/or modified to provide additional, alternative or sub-combinations. Each of these elements may be implemented in a variety of different ways. Also, while elements are at times shown as being performed in series, they may instead be performed in parallel, or may be performed at different times. Some elements may be of a conditional nature, which is not shown for simplicity.

Where a component (e.g. a connector component, etc.) is referred to above, unless otherwise indicated, reference to that component (including a reference to a "means") should be interpreted as including as equivalents of that component any component which performs the function of the described component (i.e. that is functionally equivalent), including components which are not structurally equivalent to the disclosed structure which performs the function in the illustrated exemplary embodiments of the invention.

Those skilled in the art will appreciate that directional conventions such as "vertical", "transverse", "horizontal", "upward", "downward", "forward", "backward", "inward", "outward", "vertical", "transverse" and the like, used in this description and any accompanying claims (where present) depend on the specific orientation of the apparatus described. Accordingly, these directional terms are not strictly defined and should not be interpreted narrowly.

Unless the context clearly requires otherwise, throughout the description and any claims (where present), the words "comprise," "comprising," and the like are to be construed in an inclusive sense, that is, in the sense of "including, but not limited to." As used herein, the terms "connected," "coupled," or any variant thereof, means any connection or coupling, either direct or indirect, between two or more elements; the coupling or connection between the elements can be physical, logical, or a combination thereof. Additionally, the words "herein," "above," "below," and words of similar import, shall refer to this document as a whole and not to any particular portions. Where the context permits, words using the singular or plural number may also include the plural or singular number respectively. The word "or," in reference to a list of two or more items, covers all of the following interpretations of the word: any of the items in the list, all of the items in the list, and any combination of the items in the list.

While a number of exemplary aspects and embodiments have been discussed above, those of skill in the art will recognize certain modifications, permutations, additions and sub-combinations thereof. For example:

In the embodiments described herein, the structural material used to fabricate repair structures is concrete. This is not necessary. In some applications, it may be desirable to use other curable materials (e.g. curable foam insulation, curable protective material or the like) instead of, or in addition to, concrete which may be initially be introduced into the spaces between lining systems and existing structures (or other spaces defined in part by lining systems) and allowed to cure. The systems described herein are not limited to repairing existing concrete structures. By way of non-limiting example, apparatus described herein may be used to repair existing structures comprising concrete, brick, masonry material, wood, metal, steel, other structural materials or the like.

In the embodiments described herein, the surfaces of panels (e.g. panels 102, 302, 502) are substantially flat or are generally uniformly curved. In other embodiments, panels may be provided with inward/outward corrugations. Such corrugations may extend longitudinally and/or transversely. Such corrugations may help to further prevent or minimize pillowing of panels under the weight of liquid concrete.

The lining systems described above are used to fabricate repair structures by introducing concrete or other curable material into the space between the lining system and an existing structure. The lining systems described herein may be used to fabricate repair structures that go all the way (i.e. form a closed loop) around an existing structure. This is not necessary, however, and in some embodiments, lining systems and resultant repair structures may be used to repair a portion of an existing structure.

In some embodiments, the lining systems described herein may be used as a formwork (or a portion of a formwork) to retain concrete or other curable material as it cures in the space between the lining system and the existing structure 30. In some embodiments, the lining systems described herein may be used with an external formwork (or external bracing (not shown)) which supports the lining systems while concrete or other curable material cures in the space between the lining system and the existing structure. The external formwork may be removed and optionally re-used after the curable material cures.

In some embodiments, lining system 100 may be used (with or without external formwork or bracing) to fabricate independent structures (i.e. structures that do not line existing structures and are otherwise independent of existing structures). Non-limiting examples of independent structures which may be formed with the lining systems described herein include: walls, ceilings or floors of buildings or similar structures; transportation structures (e.g. bridge supports and freeway supports); beams; foundations; sidewalks; pipes; tanks; columns; and/or the like.

Lining systems according to various embodiments may line the interior of a structure. For example, an outer formwork (comprising a lining system like any of the lining systems described herein and/or some other type of formwork) may be fabricated and an inner formwork comprising a lining system like any of the lining systems described herein may be assembled within the outer formwork. In such embodiments, the lining system may face towards the outer formwork such that the standoffs are directed towards the outer formwork. Concrete or other curable material may be introduced into the space between the inner lining system and the outer formwork and allowed to cure to complete the structure.

Structures fabricated according to various embodiments of the invention may have any appropriate shape. For example, panels of lining systems according to the invention may be curved, as shown in FIG. 2 (panels 102), may be straight, as shown in FIGS. 3 and 6 (panels 102, 302), may have outside corners, as shown in FIG. 6 (panels 303), may have inside corners (not shown) and/or the like.

In the embodiments described herein, the shape of the repair structures conform generally to the shape of the existing structures. This is not necessary. In general, the repair structure may have any desired shape by constructing suitable panels and, optionally, suitable removable bracing or formwork. For example, the cross-section of an existing structure may be generally round in shape, but a lining system having a rectangular-shaped cross-section may be used to repair such an existing structure. Similarly, the cross-section of an existing structure may be generally rectangular in shape, but a system having a circular (or curved) shaped cross-section may be used to repair such an existing structure.

Panels 502 of lining system 500 (FIGS. 8 and 9) are described above as including curved stiffeners 515 and thickened regions 517. Any of the other panels described herein may be provided with similar curved stiffeners and/or thickened regions. Panels 502" of lining system 500" (FIG. 11) are described above as including guide pieces 555". Any of the other panels described herein may be provided with similar guide pieces.

Connector component 360 of lining system 300 comprises a single stem having barbs which interact with corresponding catches in connector component 390. In some embodiments, connector components 360 may be modified to provide multiple stems, each having one or more corresponding barbs and connector components 390 may be modified to provide additional catches for engaging such additional barbs.

Portions of connector components may be coated with or may otherwise incorporate antibacterial, antiviral and/or antifungal agents. By way of non-limiting example, Microban™ manufactured by Microban International, Ltd. of New York, N.Y. may be coated onto and/or incorporated into connector components during manufacture thereof. Portions of connector component may also be coated with elastomeric sealing materials. Such sealing materials may be co-extruded with their corresponding components.

Standoffs 106, 306 are merely examples of possible standoff designs. Standoffs 106, 306 may comprise any appropriate standoff configuration to space the panels of the lining system from the existing structure. In some embodiments, standoffs 106, 306 may be integrally formed with panels or be separate components. In some embodiments, standoffs are not necessary. Surfaces of existing structures may be uneven (e.g. due to damage or to the manner of fabrication and/or the like). In some embodiments, suitable spacers, shims or the like may be used to space standoffs apart from the uneven surfaces of existing structures. Such spacers, shims or the like, which are well known in the art, may be fabricated from any suitable material including metal alloys, suitable plastics, other polymers, wood composite materials or the like.

Methods and apparatus described herein are disclosed to involve the use of concrete to repair various structures. It should be understood by those skilled in the art that in other embodiments, other curable materials could be used in addition to or as an alternative to concrete. By way of non-limiting example, a stay-in-place lining system 100 could be used to contain a structural curable material similar to concrete or some other curable material (e.g curable foam insulation, curable protective material or the like), which may be introduced into space 12 between panels 102 and existing structure when the material was in liquid form and then allowed to cure and to thereby repair existing structure 30.

The longitudinal dimensions of panels (e.g. panels 102, 302, 502) and connector components (e.g. connector components 160, 190, 360, 390, 560, 590) may be fabricated to have desired lengths or may be cut to desired lengths. Panels may be fabricated to be have modularly dimensioned transverse width dimensions to fit various existing structures and for use in various applications.

The apparatus described herein are not limited to repairing existing concrete structures. By way of non-limiting example, apparatus described herein may be used to repair existing structures comprising concrete, brick, masonry material, wood, metal, steel, other structural materials or the like. One particular and non-limiting example of a metal or steel object that may be repaired in accordance various embodiments described herein is a street lamp post, which may degrade because of exposure to salts and/or other chemicals used to melt ice and snow in cold winter climates.

In some applications, corrosion (e.g. corrosion of rebar) is a factor in the degradation of the existing structure. In such applications, apparatus according to various embodiments of the invention may incorporate corrosion control components such as those manufactured and provided by Vector Corrosion Technologies, Inc. of Winnipeg, Manitoba, Canada and described at www.vector-corrosion.com. As a non-limiting example, such corrosion control components may comprise anodic units which may comprise zinc and which may be mounted to (or otherwise connected to) existing rebar in the existing structure and/or to new rebar introduced by the repair, reinforcement, restoration and/or protection apparatus of the invention. Such anodic corrosion control components are marketed by Vector Corrosion Technologies, Inc. under the brand name Galvanode®. Other corrosion control systems, such as impressed current cathodic protection (ICCP) systems, electrochemical chloride extraction systems and/or electrochemical re-alkalization systems could also be used in conjunction with the apparatus of this invention. Additionally or alternatively, anti-corrosion additives may be added to concrete or other curable materials used to fabricate repair structures in accordance with particular embodiments of the invention.

As discussed above, the illustrated embodiment described herein is applied to provide a repair structure for an existing structure having a particular shape. In general, however, the shape of the existing structures described herein are meant to be exemplary in nature and methods and apparatus of various embodiments may be used with existing structures having virtually any shape. In particular applications, apparatus according to various embodiments may be used to repair (e.g. to cover) an entirety of an existing structure and/or any subset of the surfaces or portions of the surfaces of an existing structure. Such surfaces or portions of surfaces may include longitudinally extending surfaces or portions thereof, transversely extending surfaces or portions thereof, side surfaces or portions thereof, upper surfaces or portions thereof, lower surfaces or portions thereof and any corners, curves and/or edges in between such surfaces or surface portions.

While a number of exemplary aspects and embodiments have been discussed above, those of skill in the art will recognize certain modifications, permutations, additions and sub-combinations thereof. It is therefore intended that the following appended aspects and aspects hereafter introduced are interpreted to include all such modifications, permutations, additions and sub-combinations and the scope of the aspects should not be limited by the preferred embodiments set forth in the examples, but should be given the broadest interpretation consistent with the description as a whole.

What is claimed is:

1. A stay in place lining for lining a structure of concrete or other curable construction material comprising:

a plurality of panels connectable in edge to edge relation via complementary connector components on their longitudinal edges to define at least a portion of a perimeter of the lining;

wherein each panel comprises a first connector component comprising a protrusion on a first longitudinal edge thereof and a second connector component comprising a receptacle on a second longitudinal edge thereof, each edge-to-edge connection comprising the protrusion of the first panel extended into the receptacle of the second panel;

the protrusion comprising a generally straight stem extending from a base of the protrusion and a first barb extending from the stem and toward the base of the protrusion as it extends away from the stem;

the receptacle comprising a catch extending into the receptacle and positioned to engage the first barb when the protrusion is extended into the receptacle, the engagement of the first barb and the catch retaining the connector components in a locked configuration;

wherein the protrusion extends into the receptacle in a direction generally parallel to transverse edges of the panels, the transverse edges generally orthogonal to the longitudinal edges;

wherein for each panel, the first connector component is offset from a plane of a body of that panel; and wherein the receptacle comprises a securing protrusion comprising an indentation in a wall of the receptacle, the indentation extending into an interior of the receptacle and contacting the stem of the first connector component when the edge-to-edge connection is made.

2. A stay-in-place lining according to claim 1 wherein the edge-to-edge connection provides a generally flat surface between connected panels.

3. A stay-in-place lining according to claim 1 wherein at least one of the first connector component and the second connector component is resiliently deformed when the connection is made.

4. A stay-in-place lining according to claim 1 wherein the protrusion comprises a second barb and one of the first and second barbs applies force to an opening of the receptacle upon insertion of the one of the first and second barbs into the receptacle to cause the securing protrusion to move away from the protrusion thereby reducing friction between the first and second connectors.

5. A stay-in-place lining according to claim 1 wherein the receptacle is resiliently deformed when the protrusion extends therein and the securing protrusion applies a restorative force to the protrusion when the edge-to-edge connection is made.

6. A stay-in-place lining according to claim 1 wherein the second connector component comprises a tab for disengaging the edge-to-edge connection after the connection has been made.

7. A stay-in-place lining for lining a structure of concrete or other curable construction material comprising:

a plurality of panels connectable in edge to edge relation via complementary connector components on their longitudinal edges to define at least a portion of a perimeter of the lining;

wherein each panel comprises a first connector component comprising a protrusion on a first longitudinal edge thereof and a second connector component comprising a receptacle on a second longitudinal edge thereof, each edge-to-edge connection comprising the protrusion of the first panel extended into the receptacle of the second panel;

the protrusion comprising a generally straight stem extending from a base of the protrusion and a first barb extending from the stem and toward the base of the protrusion as it extends away from the stem;

the receptacle comprising a catch extending into the receptacle and positioned to engage the first barb when the protrusion is extended into the receptacle, the engagement of the first barb and the catch retaining the connector components in a locked configuration;

wherein the protrusion extends into the receptacle in a direction generally parallel to transverse edges of the panels, the transverse edges generally orthogonal to the longitudinal edges; and wherein for each panel, the first connector component is offset from a plane of a body of that panel wherein the first connector component comprises a concavity and the second connector component comprises a finger shaped to be complementary to the concavity, the finger extending into the concavity and forming a finger lock when the edge-to-edge connection is made.

8. A stay-in-place lining according to claim 7 wherein the finger lock forms a generally flat surface between adjacent edge-to-edge panels.

9. A stay-in-place lining according to claim 1 wherein the protrusion comprises a second barb extending from the stem and toward the base of the protrusion as it extends away from the stem and the receptacle comprises a second catch extending into the receptacle and positioned to engage the second barb when the protrusion is extended into the receptacle.

10. A stay-in-place lining according to claim 9 wherein the first and second barbs extend from opposing sides of the stem.

11. A stay-in-place lining according to claim 9 wherein the first and second barbs are spaced apart from one another along the length of the stem.

12. A stay-in-place lining according to claim 11 wherein the securing protrusion contacts the stem of the first connector component at a location between the spaced apart first and second barbs when the edge-to-edge connection is made.

13. A stay-in-place lining according to claim 7 wherein the protrusion comprises a second barb extending from the stem and toward the base of the protrusion as it extends away from the stem and the receptacle comprises a second catch extending into the receptacle and positioned to engage the second barb when the protrusion is extended into the receptacle.

14. A stay-in-place lining according to claim 13 wherein the first and second barbs extend from opposing sides of the stem.

15. A stay-in-place lining according to claim 14 wherein the first and second barbs are spaced apart from one another along the length of the stem.

16. A stay-in-place lining according to claim 15 wherein the receptacle comprises a securing protrusion that contacts the stem of the first connector component at a location between the spaced apart first and second barbs when the edge-to-edge connection is made.

17. A method for fabricating a structure of concrete or other curable construction material, the method comprising:

connecting a plurality of panels in edge to edge relation via complementary connector components on their longitudinal edges to define at least a portion of a lining;

forming a formwork around a space in which to receive the concrete or other curable material;

assembling the connected plurality of panels such that the connected plurality of panels provides a lining which defines at least a portion of the space in which to receive the concrete or other curable material; and introducing the concrete or other curable material into the space in an uncured state;

wherein, connecting the plurality of panels in edge to edge relation comprises, for each edge-to-edge connection between a first panel and a second panel:

extending a protrusion of a first connector component on a first longitudinal edge of the first panel and offset from a plane of a body of the first panel into a receptacle of a second connector component on a second longitudinal edge of the second panel by moving the protrusion into the receptacle in a direction generally parallel to the plane of the first panel;

wherein the receptacle is resiliently deformed by the protrusion to apply a restorative force to the protrusion to maintain the edge-to-edge connection;

wherein the protrusion comprises a generally straight stem extending from a base of the protrusion and a barb extending from the stem and toward the base of the protrusion as it extends away from the stem;

engaging the barb with a catch, the catch extending into the receptacle and positioned to engage the barb when the protrusion is extended into the receptacle, the engagement of the barb and the catch retaining the connector components in a locked configuration; and wherein the receptacle comprises a securing protrusion comprising an indentation in a wall of the receptacle, the indentation extending into an interior of the receptacle and contacting the stem of the first connector component when the edge-to-edge connection is made.

18. A method according to claim 17 wherein the formwork comprises the connected plurality of panels.

19. A method according to claim 17 wherein assembling the connected plurality of panels comprises positioning the panels to line at least a portion of an interior surface of the formwork.

* * * * *